US011307527B2

(12) United States Patent
Sato et al.

(10) Patent No.: US 11,307,527 B2
(45) Date of Patent: Apr. 19, 2022

(54) PROCESS CARTRIDGE HAVING DRUM CARTRIDGE, TONER CARTRIDGE AND WASTE TONER CONVEYOR TUBE

(71) Applicant: BROTHER KOGYO KABUSHIKI KAISHA, Nagoya (JP)

(72) Inventors: Shougo Sato, Seto (JP); Hideshi Nishiyama, Owariasahi (JP); Aya Adachi, Aichi (JP); Atsushi Fukaya, Toyohashi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/088,658

(22) Filed: Nov. 4, 2020

(65) Prior Publication Data

US 2021/0048774 A1 Feb. 18, 2021

Related U.S. Application Data

(63) Continuation of application No. 16/747,713, filed on Jan. 21, 2020, now Pat. No. 10,831,146, which is a (Continued)

(30) Foreign Application Priority Data

Mar. 17, 2017 (JP) ..... JP2017-053419

(51) Int. Cl.
*G03G 21/00* (2006.01)
*G03G 21/10* (2006.01)
(Continued)

(52) U.S. Cl.
CPC ..... *G03G 21/105* (2013.01); *G03G 21/12* (2013.01); *G03G 21/1821* (2013.01); *G03G 2221/1624* (2013.01)

(58) Field of Classification Search
CPC .. G03G 21/1814; G03G 21/105; G03G 21/12; G03G 21/1821; G03G 2221/1624; G03G 2221/1853
(Continued)

(56) References Cited

U.S. PATENT DOCUMENTS 5,398,098 A 3/1995 Fukunaga et al.
5,835,822 A 11/1998 Nagasaki et al.
(Continued)

FOREIGN PATENT DOCUMENTS

JP 6-222628 A 8/1994
JP 9-81016 A 3/1997
(Continued)

OTHER PUBLICATIONS

Office Action (Notice of Reasons for Refusal) issued in corresponding Japanese Patent Application No. 2017-053419, dated Mar. 2, 2021.

*Primary Examiner* — Robert B Beatty
(74) *Attorney, Agent, or Firm* — Merchant & Gould P.C.

(57) ABSTRACT

A process cartridge having a drum cartridge and a toner cartridge is provided. The drum cartridge includes a photosensitive drum, a cleaner, a conveyer tube, a developing roller, and a developing device. The toner cartridge is attachable to the drum cartridge and is located on a side of the developing roller opposite to the photosensitive drum in an attaching direction. The toner cartridge includes a waste toner container to store the toner conveyed through the conveyer tube and a toner container to store the toner to be supplied to the photosensitive drum. The toner container communicates with a developing chamber in the developing device and is located at least partly between the waste toner container and the developing chamber. The conveyer tube extends in the attaching direction and is arranged to overlap
(Continued)

the photosensitive drum, the toner container, and the waste toner container in a view along an axial direction.

12 Claims, 15 Drawing Sheets

Related U.S. Application Data continuation of application No. 16/578,877, filed on Sep. 23, 2019, now Pat. No. 10,585,384, which is a continuation of application No. 16/291,248, filed on Mar. 4, 2019, now Pat. No. 10,466,643, which is a continuation of application No. 15/685,547, filed on Aug. 24, 2017, now Pat. No. 10,254,705.

(51) Int. Cl.
*G03G 21/12* (2006.01)
*G03G 21/18* (2006.01)

(58) Field of Classification Search
USPC ..... 399/120, 359, 360
See application file for complete search history.

(56) References Cited

U.S. PATENT DOCUMENTS

| | | | | |
|---|---|---|---|---|
| 7,945,203 | B2 | 5/2011 | Shimizu et al. | |
| 8,081,918 | B2 | 12/2011 | Suzuki | |
| 8,260,186 | B2 | 9/2012 | Kubota et al. | |
| 9,158,221 | B2 | 10/2015 | Sato | |
| 9,448,530 | B1 | 9/2016 | Koyama | |
| 10,082,765 | B2 | 9/2018 | Nishiyama et al. | |
| 2008/0145119 | A1 | 6/2008 | Tatsumi et al. | |
| 2011/0076056 | A1* | 3/2011 | Sato ..... | G03G 21/12 399/120 |
| 2013/0259495 | A1 | 10/2013 | Ota | |
| 2015/0261173 | A1 | 9/2015 | Sato | |
| 2017/0285566 | A1 | 10/2017 | Shimizu et al. | |
| 2017/0285567 | A1 | 10/2017 | Fukaya et al. | |

FOREIGN PATENT DOCUMENTS

| | | | |
|---|---|---|---|
| JP | 2008-116537 | A | 5/2008 |
| JP | 2011-118040 | A | 6/2011 |
| JP | 2011-248136 | A | 12/2011 |
| JP | 2015-175936 | A | 10/2015 |

* cited by examiner

PROCESS CARTRIDGE HAVING DRUM CARTRIDGE, TONER CARTRIDGE AND WASTE TONER CONVEYOR TUBE

CROSS REFERENCE TO RELATED APPLICATION

This application is a continuation of U.S. application Ser. No. 16/747,713, filed Jan. 21, 2020, now U.S. Pat. No. 10,831,146, which is a continuation of U.S. application Ser. No. 16/578,877, filed Sep. 23, 2019, now U.S. Pat. No. 10,585,384, which is a continuation of U.S. application Ser. No. 16/291,248, filed on Mar. 4, 2019, now U.S. Pat. No. 10,466,643, which is a continuation of U.S. application Ser. No. 15/685,547, filed on Aug. 24, 2017, now U.S. Pat. No. 10,254,705, which claims priority from Japanese Patent Application No. 2017-053419, filed on Mar. 17, 2017. The entire subject matter of the aforementioned applications are incorporated herein by reference.

BACKGROUND

Technical Field

An aspect of the present disclosure is related to a process cartridge.

Related Art

A process cartridge configured to be detachably attached to an image forming apparatus is known. The process cartridge may include, for example, a photosensitive drum, a developing roller, a cleaner, a waste toner container, and a conveyer tube. The developing roller may supply toner to a surface of the photosensitive drum. The cleaner may remove the toner from the surface of the photosensitive drum. The waste toner container may store the removed toner. The conveyer tube may convey the toner from the cleaner to the waste toner container.

SUMMARY

The process cartridge with the photosensitive drum, the developing roller, the cleaner, the waste toner container, and the conveyer tube may preferably be downsized, in particularly, in height.

The present disclosure is advantageous in that a process cartridge with a reduced height is provided.

According to an aspect of the present disclosure, a process cartridge, having a drum cartridge and a toner cartridge, is provided. The drum cartridge includes a photosensitive drum; a cleaner configured to remove toner from a circumferential surface of the photosensitive drum; a conveyer tube for conveying the toner removed from the circumferential surface of the photosensitive drum by the cleaner; a developing roller; and a developing device having a developing chamber to accommodate the developing roller. The toner cartridge is attachable to the drum cartridge along an attaching direction. The toner cartridge is located at a position on a side of the developing roller opposite to the photosensitive drum in the attaching direction while the toner cartridge is attached to the drum cartridge. The toner cartridge includes a waste toner container configured to store the toner conveyed through the conveyer tube, the waste toner container being coupled with the conveyer tube while the toner cartridge is attached to the drum cartridge; and a toner container configured to store the toner to be supplied to the photosensitive drum, the toner container being, while the toner cartridge is attached to the drum cartridge, configured to communicate with the developing chamber and located at least partly between the waste toner container and the developing chamber along the attaching direction. The conveyer tube extends in the attaching direction and is arranged to overlap the photosensitive drum, the toner container, and the waste toner container in a view along an axial direction being a direction of an axis of the photosensitive drum.

BRIEF DESCRIPTION OF THE ACCOMPANYING DRAWINGS

Figure 4A:
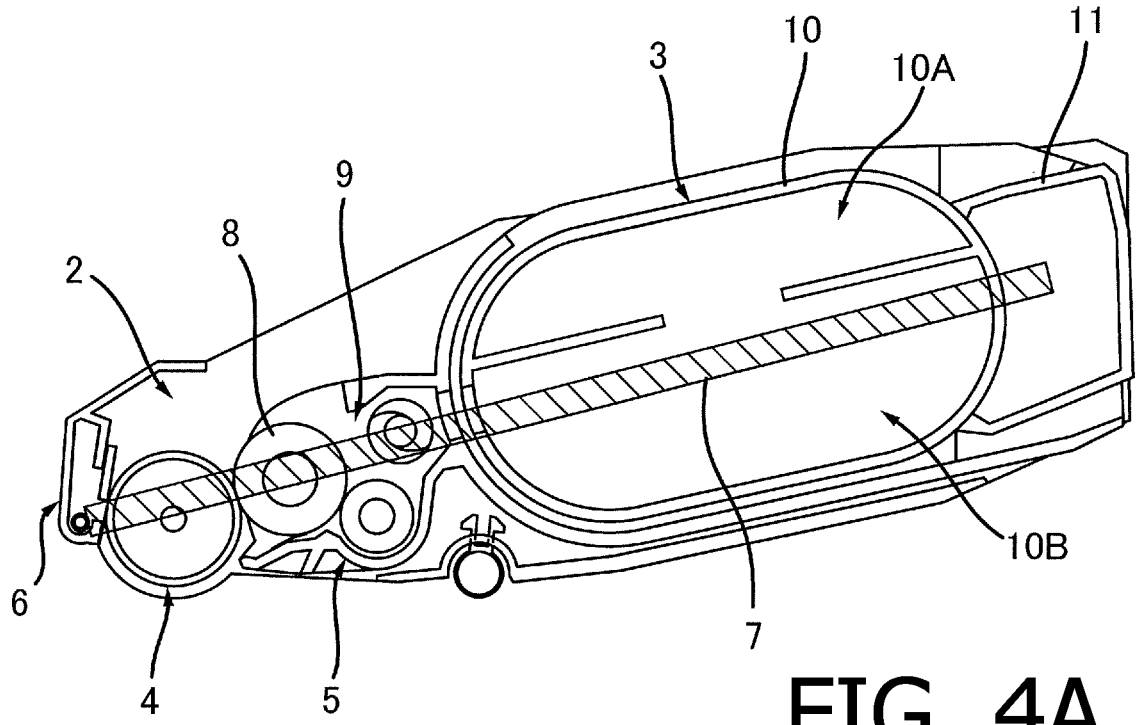
Figure 4B:
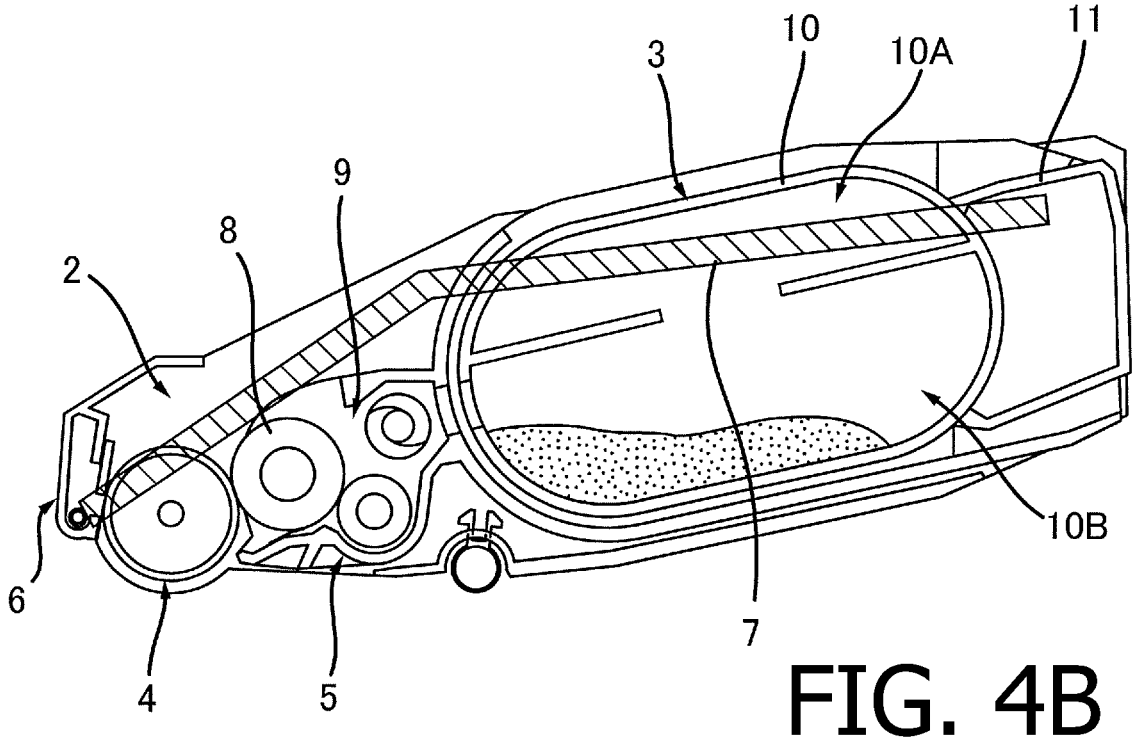

FIG. 4A illustrates a cross-sectional view of the process cartridge, with a conveyer tube overlapping at least one of inner rooms in a toner container, according to the embodiment of the present disclosure. FIG. 4B illustrates a cross-sectional view of the process cartridge, with the conveyer tube overlapping an upper one of the inner rooms in the toner container that does not contain toner, according to the embodiment of the present disclosure.

Figure 5A:
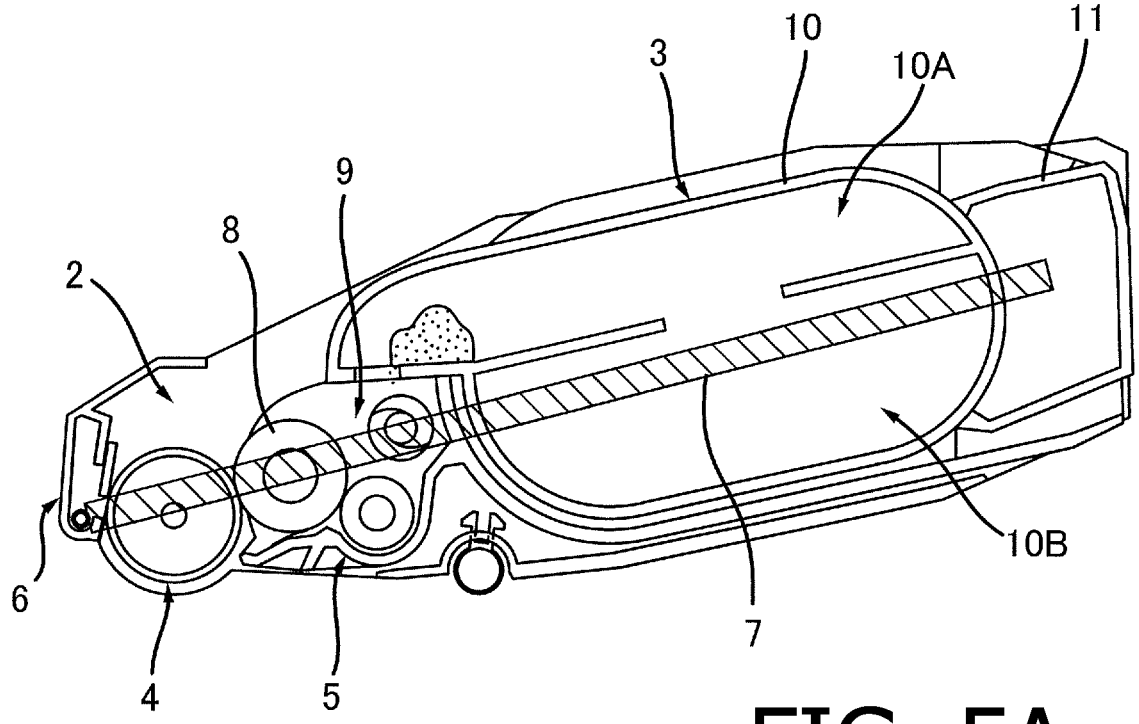
Figure 5B:
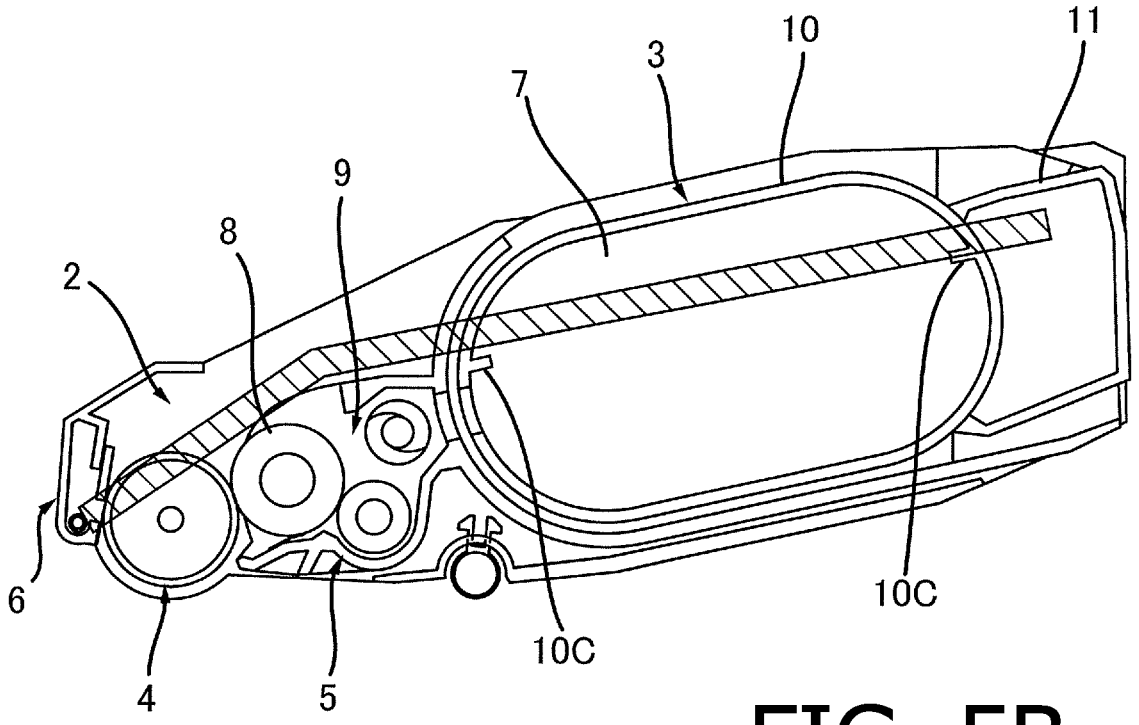

FIG. 5A illustrates a cross-sectional view of the process cartridge, with the conveyer tube overlapping a lower one of the inner rooms in the toner container that does not contain toner, according to the embodiment of the present disclosure. FIG. 5B illustrates a cross-sectional view of the process cartridge, with inward protrusions in an inner room in the toner container, according to the embodiment of the present disclosure.

Figure 6A:
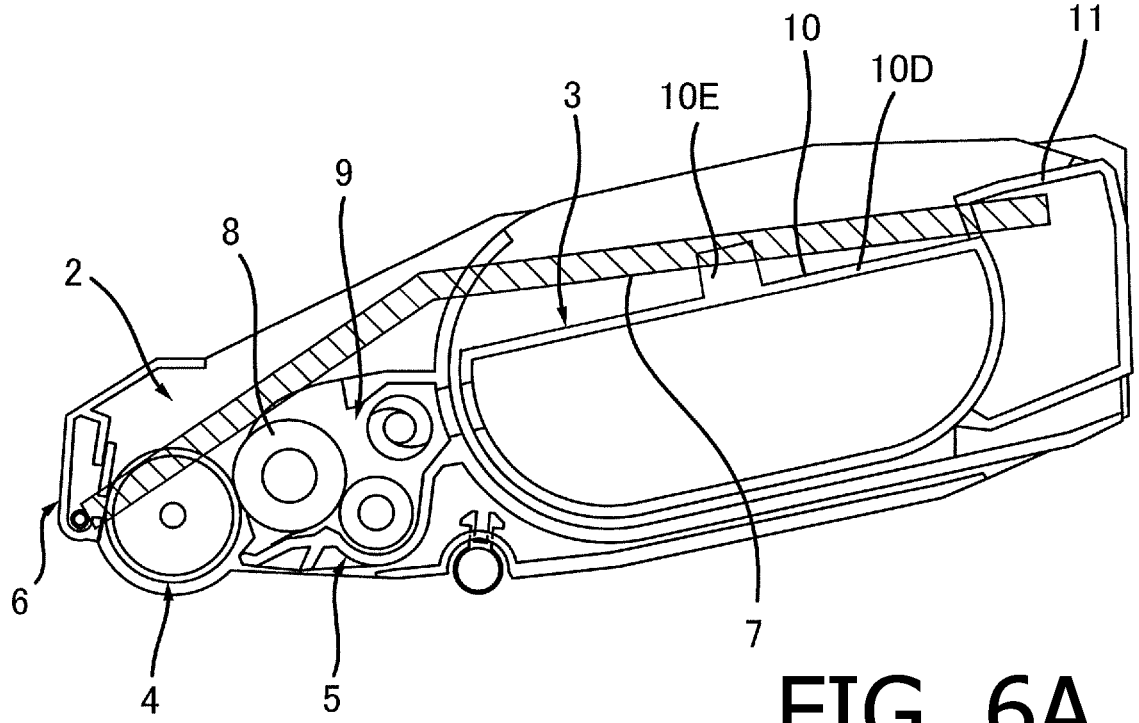
Figure 6B:
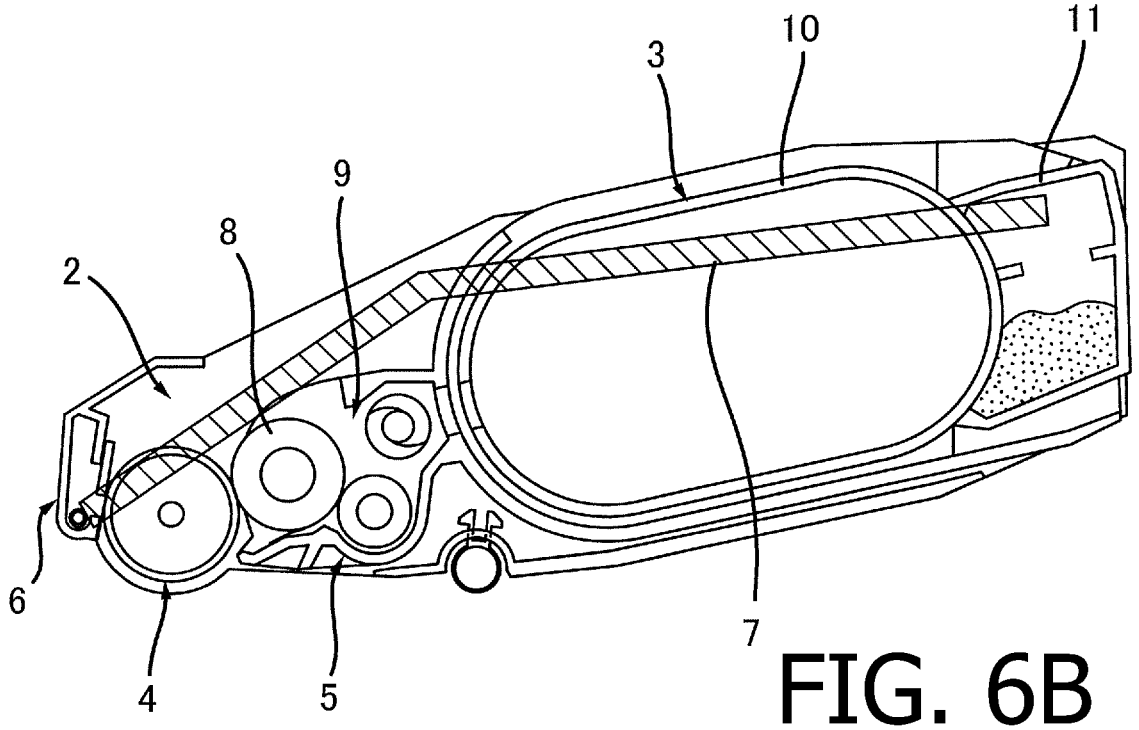

FIG. 6A illustrates a cross-sectional view of the process cartridge, with the toner container having an outward protrusion, and the conveyer tube overlapping the protrusion, according to the embodiment of the present disclosure. FIG. 6B illustrates a cross-sectional view of the process cartridge, with the conveyer tube overlapping an upper one of the inner rooms in the toner container that does not contain toner, according to the embodiment of the present disclosure.

Figure 7A:
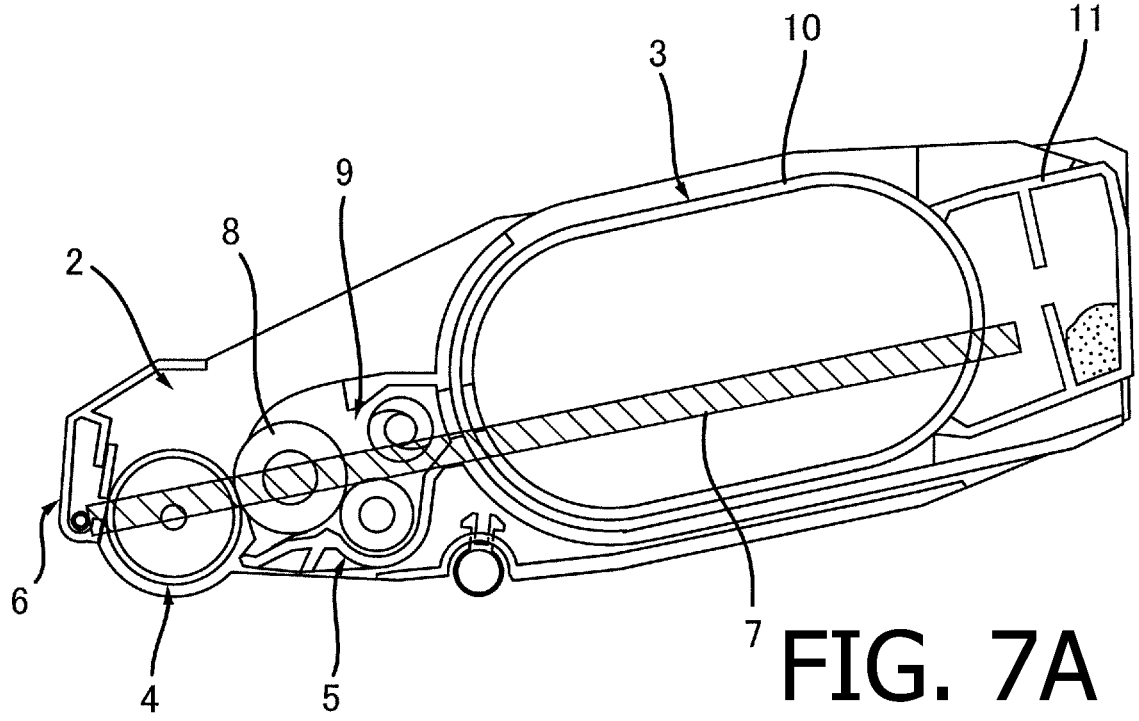
Figure 7B:
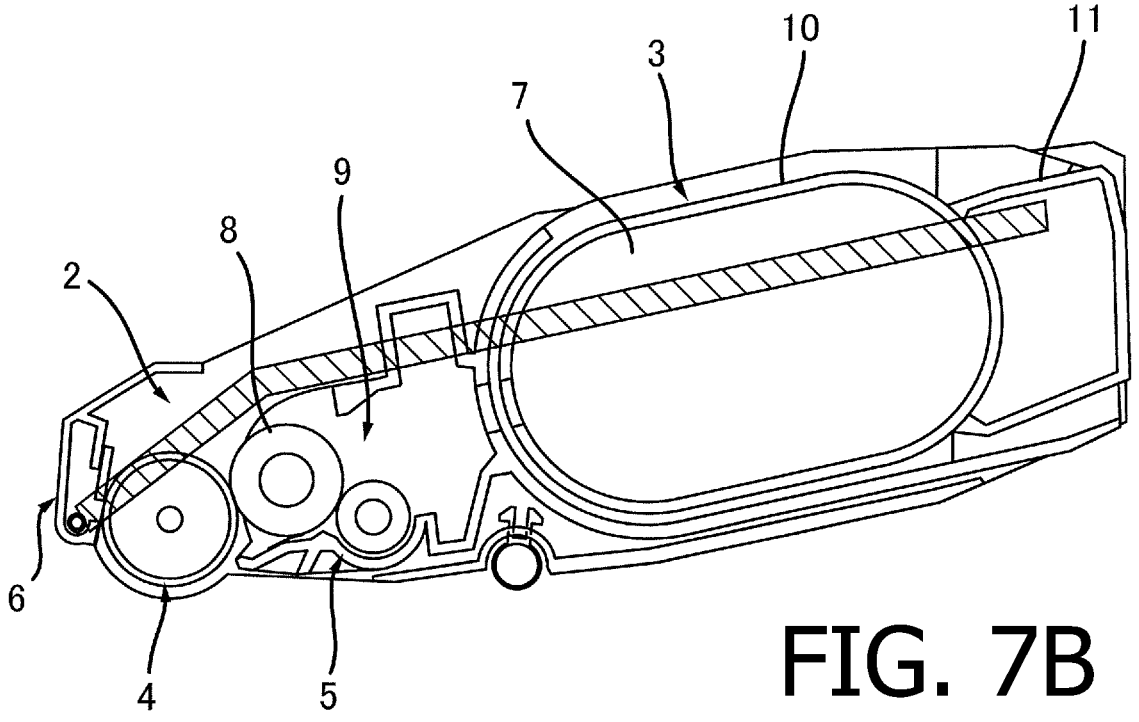

FIG. 7A illustrates a cross-sectional view of the process cartridge, with the conveyer tube overlapping an intermediate one of inner rooms in a waste toner container that does not contain toner located between the toner container and another one of the inner rooms containing the toner in the waste toner container, according to the embodiment of the present disclosure. FIG. 7B illustrates a cross-sectional view of the process cartridge, with the conveyer tube overlapping a developing chamber in a developing device at a part that does not accommodate a developing roller, according to the embodiment of the present disclosure.

Figure 8A:
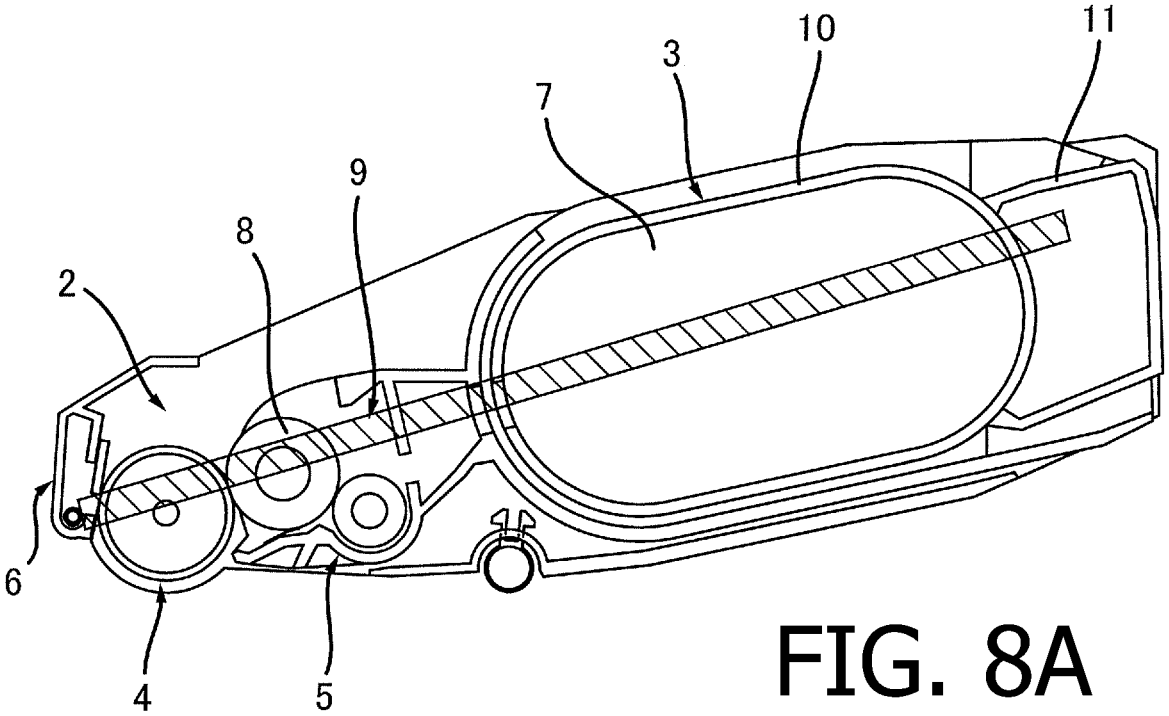

FIG. 8A illustrates a cross-sectional view of the process cartridge, with the conveyer tube overlapping an inner room between a part of the developing chamber that accommodates the developing roller and the toner container, according to the embodiment of the present disclosure.

Figure 8B:
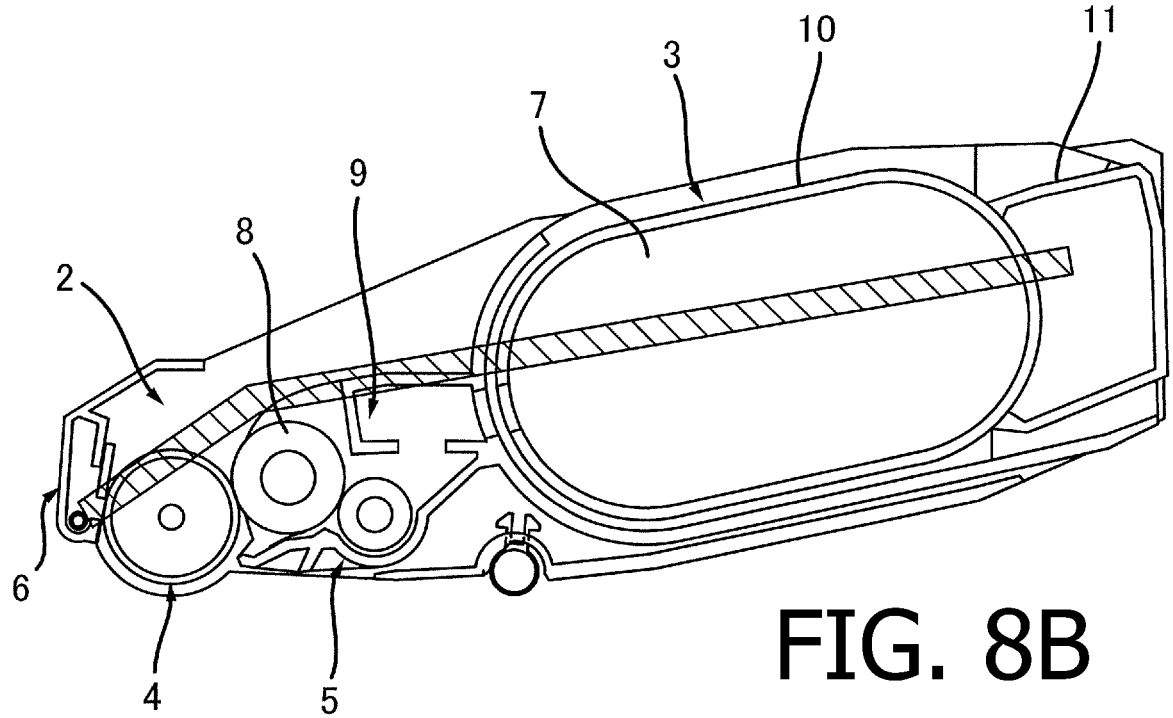

FIG. 8B illustrates a cross-sectional view of the process cartridge, with the conveyer tube overlapping an inner room between a part of the developing chamber that accommodates the developing roller and the toner container, avoiding the part of the developing chamber that accommodates the developing roller, according to the embodiment of the present disclosure.

Figure 9:
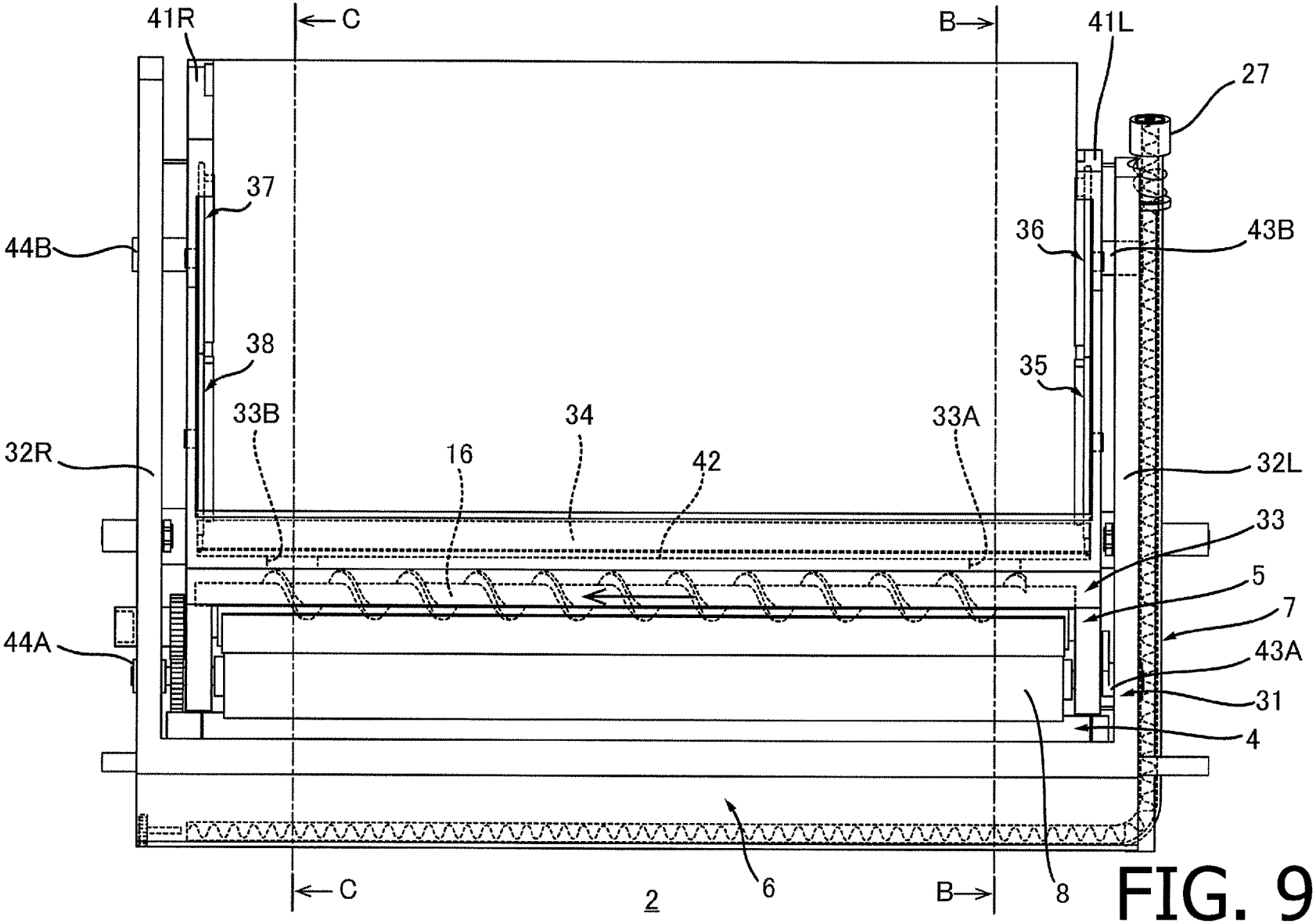

FIG. 9 is a plan view of a drum cartridge being a part of the process cartridge according to the embodiment of the present disclosure.

Figure 10A:
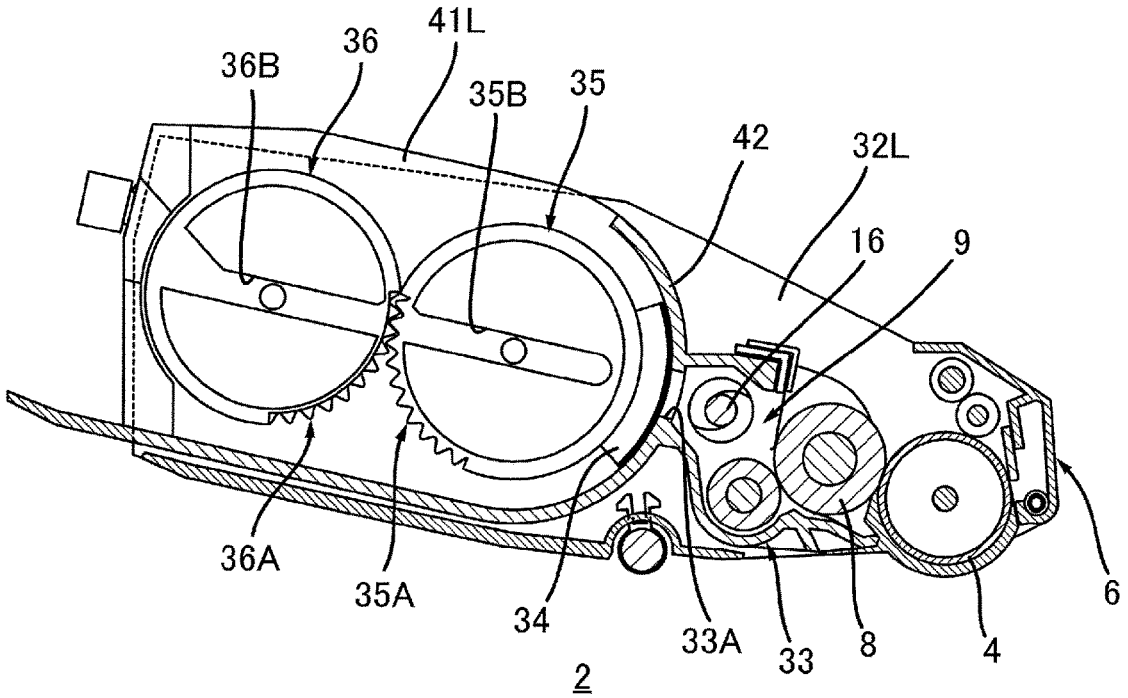
Figure 10B:
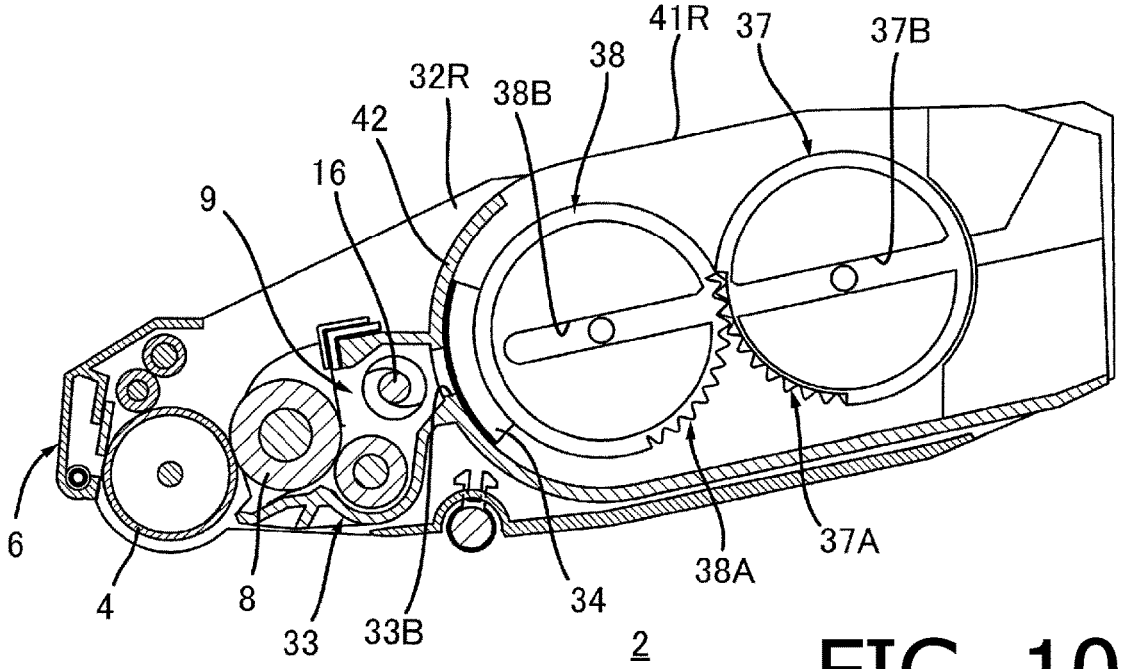

FIG. 10A illustrates a cross-sectional view of the drum cartridge according to the embodiment of the present disclosure viewed at a line B-B shown in FIG. 9. FIG. 10B illustrates a cross-sectional view of the drum cartridge according to the embodiment of the present disclosure viewed at a line C-C shown in FIG. 9.

Figure 11:
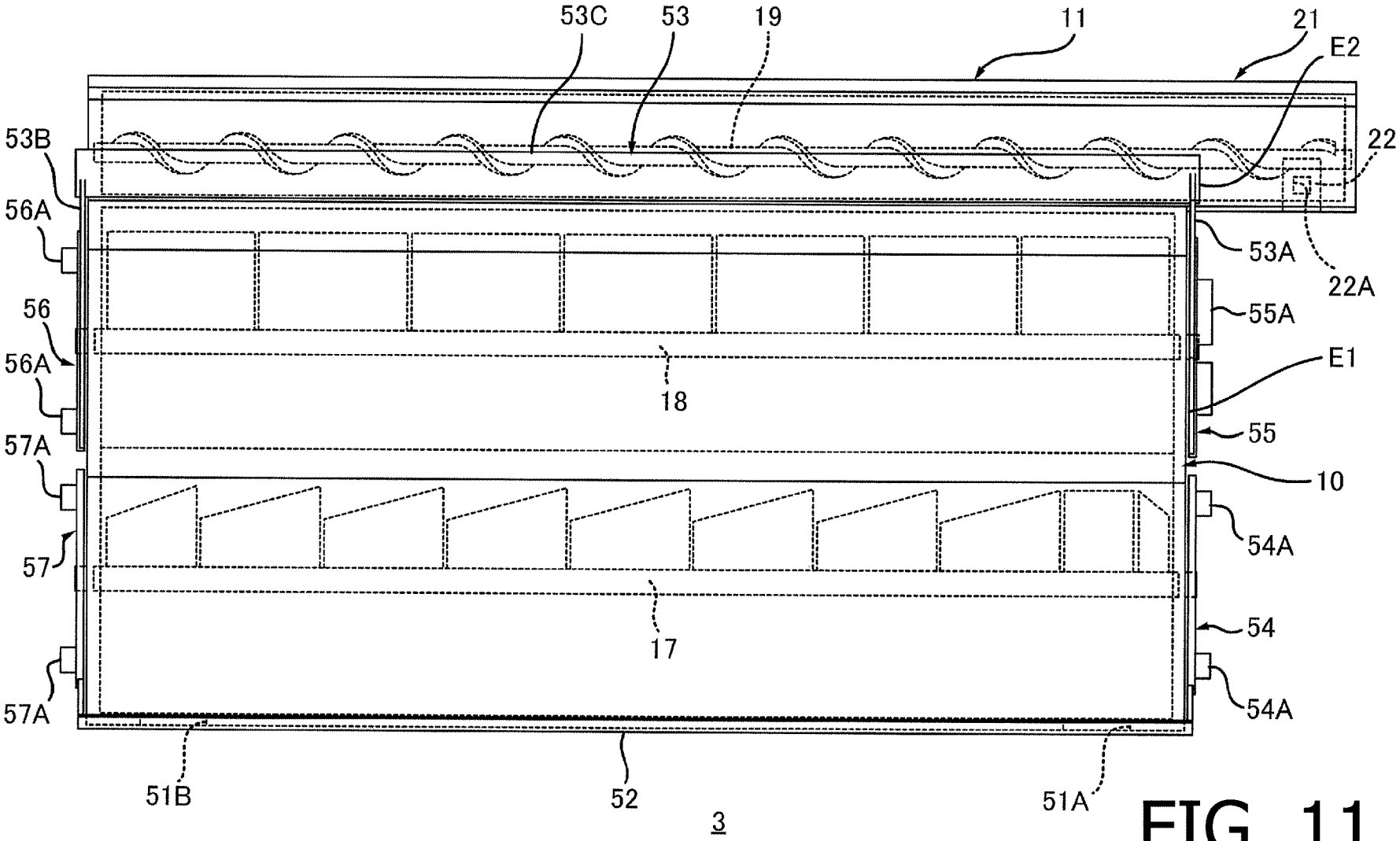

FIG. 11 is a plan view of a toner cartridge being a part of the process cartridge according to the embodiment of the present disclosure.

Figure 12A:
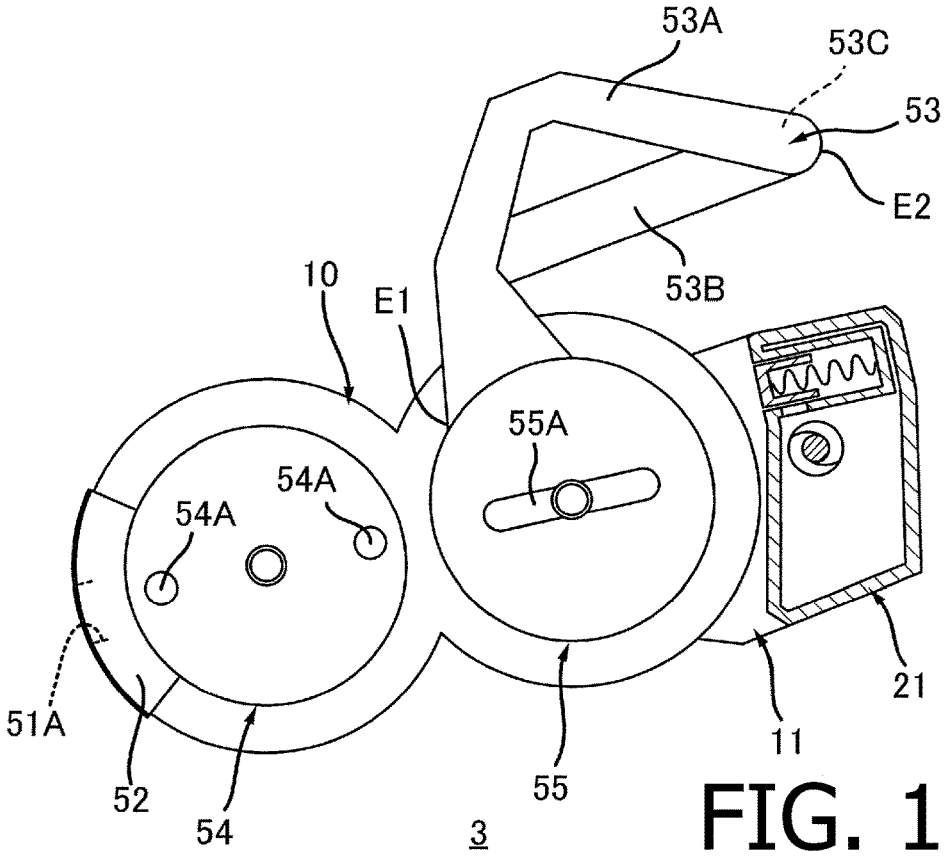
Figure 12B:
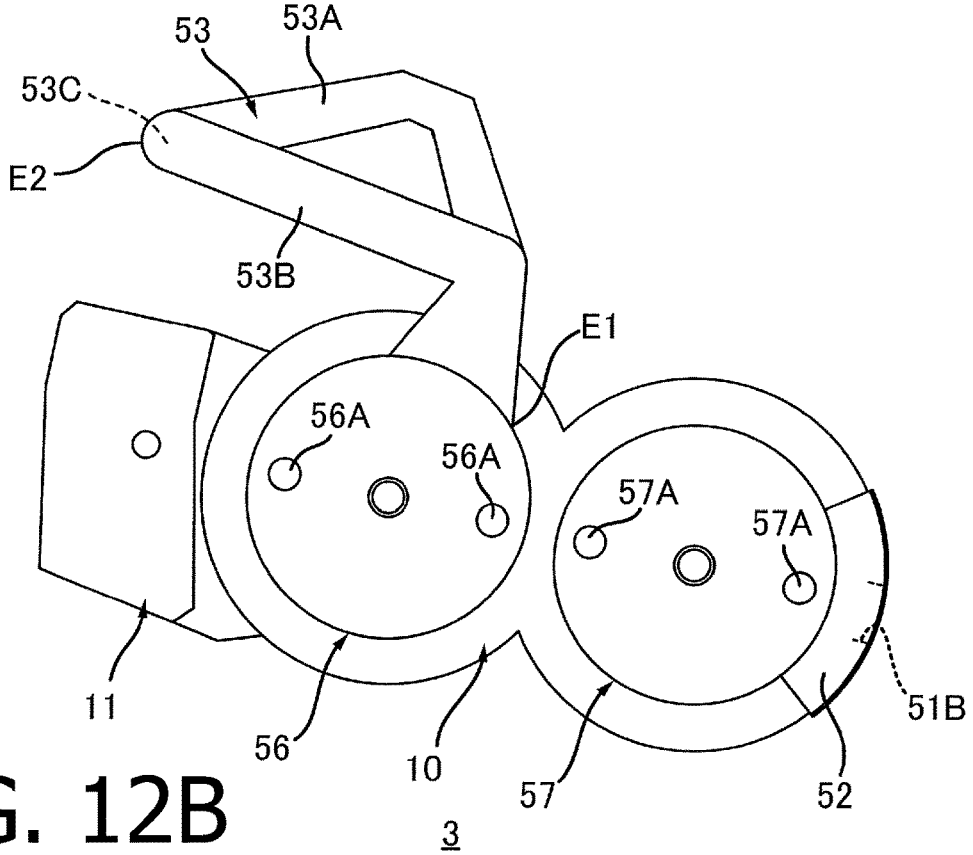

FIG. 12A illustrates a sideward view of the toner cartridge according to the embodiment of the present disclosure viewed from one side along an axial direction. FIG. 12B illustrates a sideward view of the toner cartridge according to the embodiment of the present disclosure viewed from another side along an axial direction.

Figure 13A:
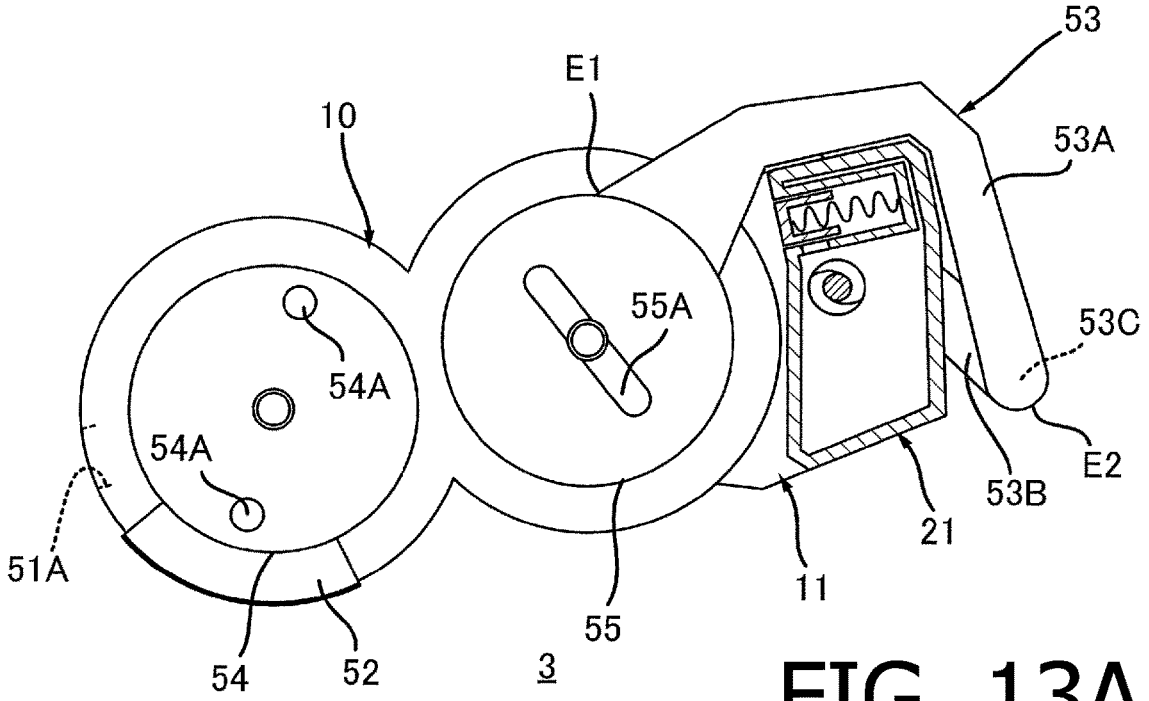
Figure 13B:
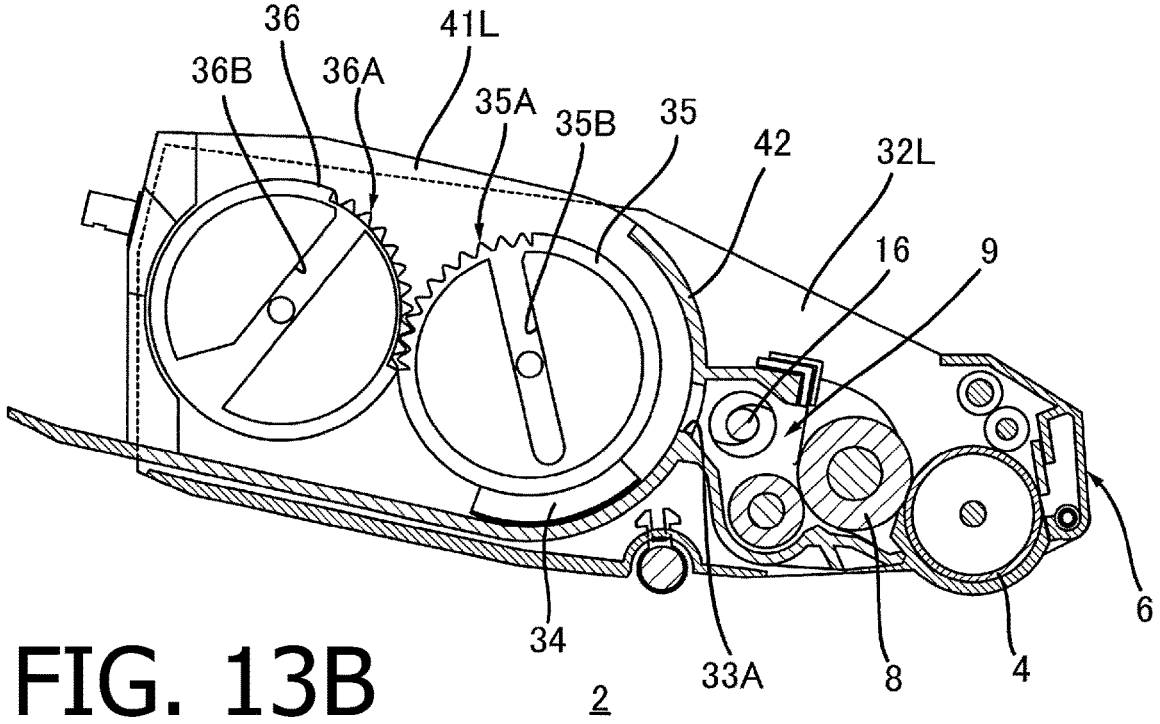

FIG. 13A illustrates the toner cartridge according to the embodiment of the present disclosure with a toner shutter at an open position. FIG. 13B illustrates the toner cartridge according to the embodiment of the present disclosure with a developer shutter at an open position.

Figure 14:
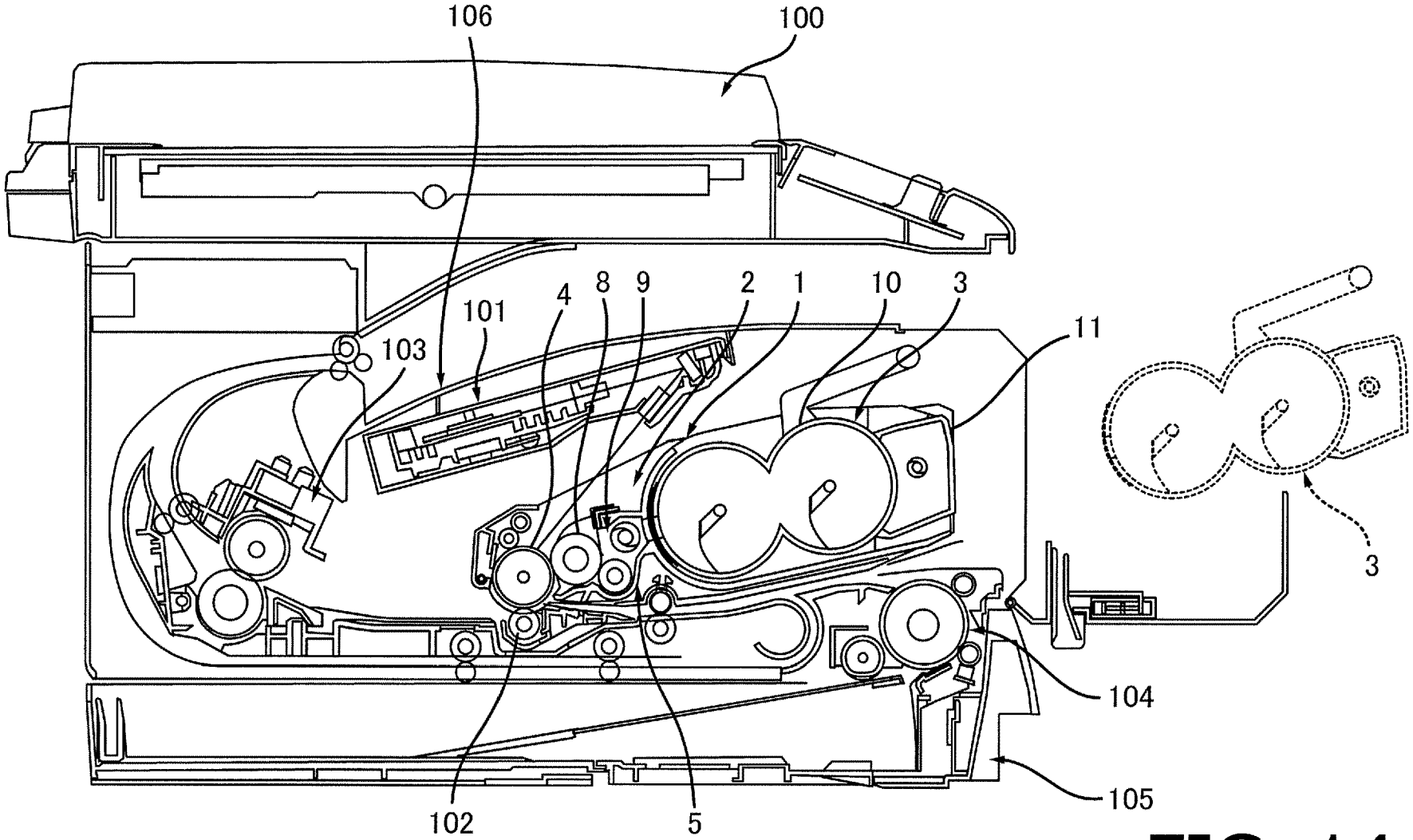

FIG. 14 illustrates a cross-sectional view of the process cartridge, to be used in an image forming apparatus, according to the embodiment of the present disclosure.

Figure 15A:
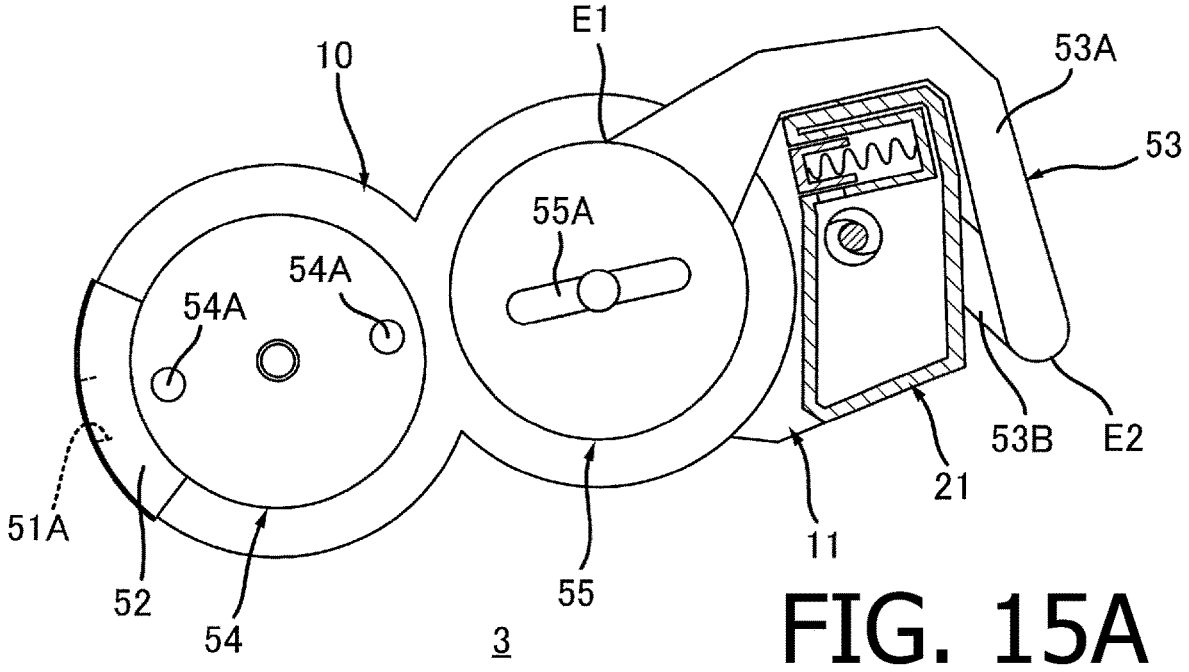
Figure 15B:
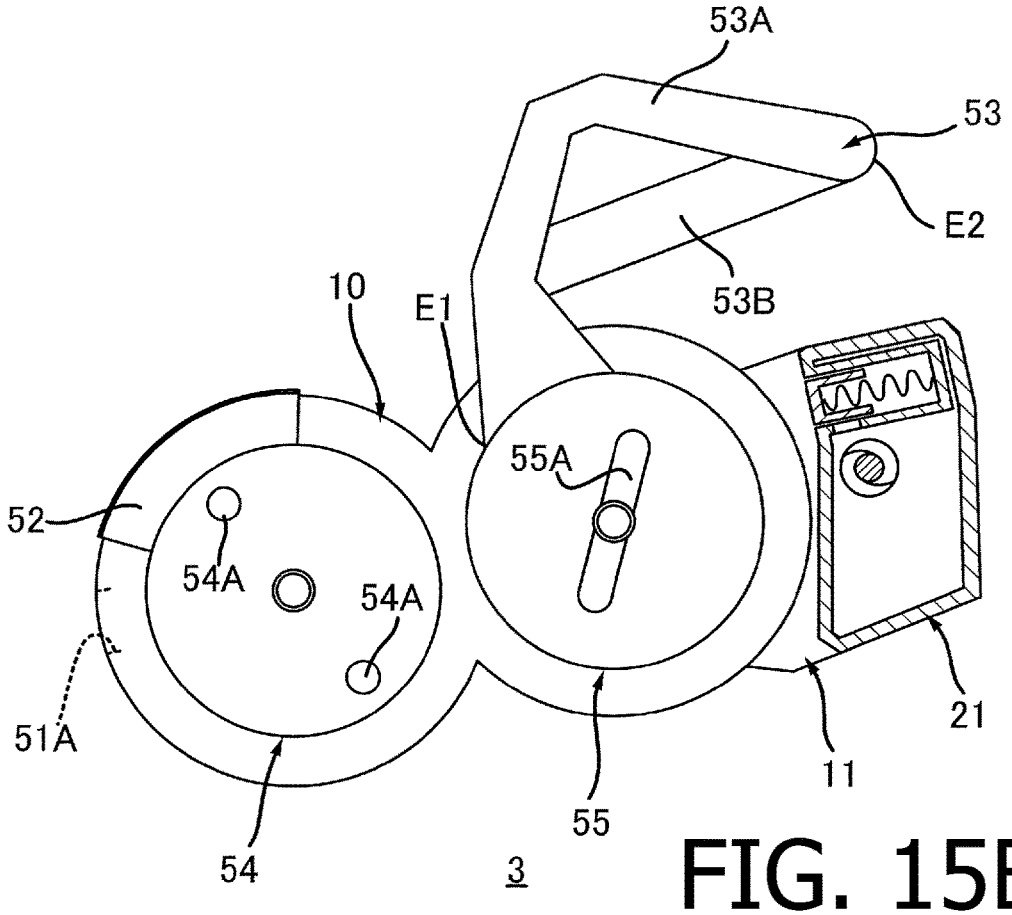

FIG. 15A illustrates a sideward view of the process cartridge according to another embodiment of the present disclosure with a toner shutter being at a closure position. FIG. 15B illustrates a sideward view of the process cartridge according to another embodiment of the present disclosure with the toner shutter being at an open position.

DETAILED DESCRIPTION

Hereinafter, described will be embodiments of the present disclosure with reference to the accompanying drawings.

1. Overall Configuration of Process Cartridge

Figure 1:
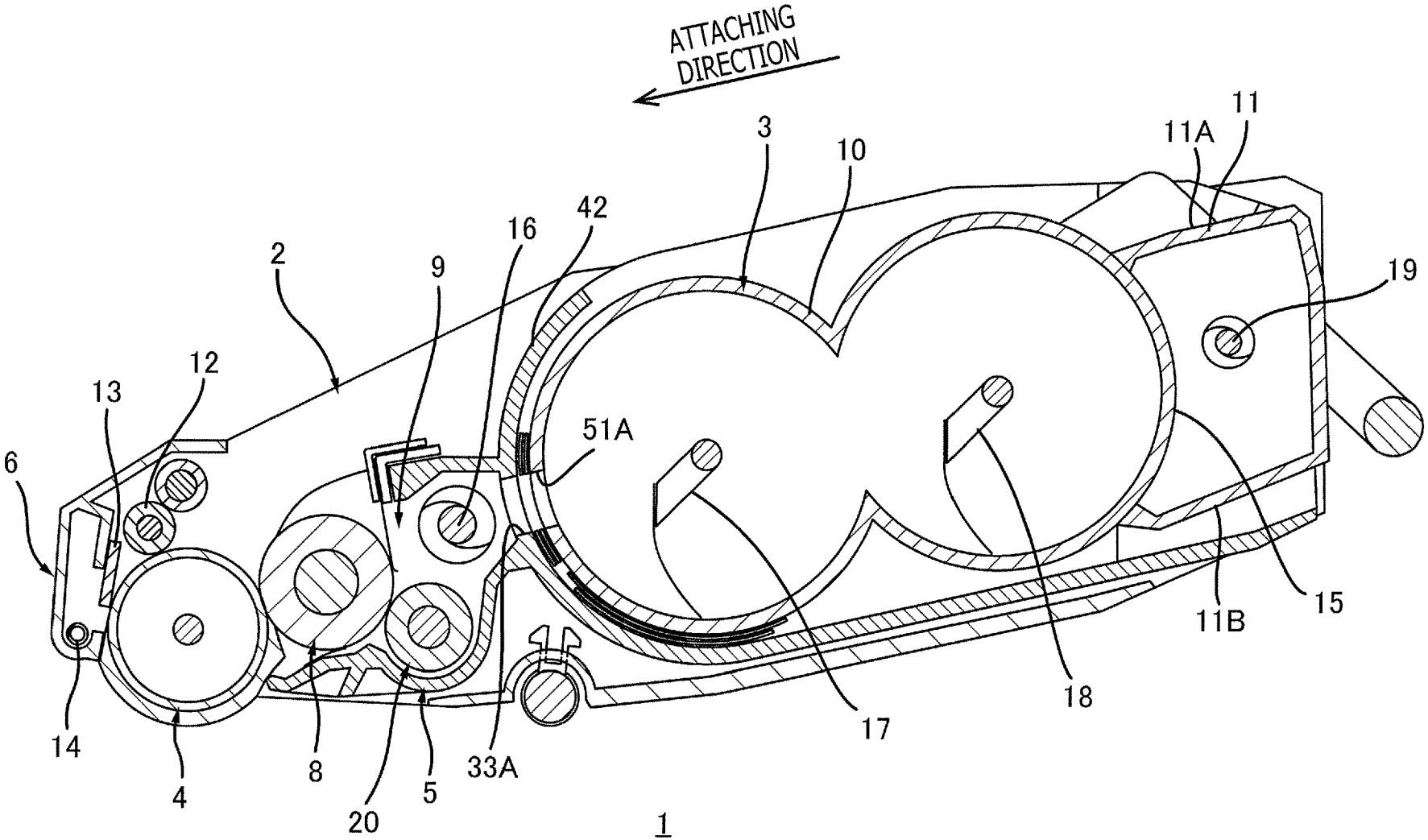
FIG. 1 illustrates a cross-sectional view of a process cartridge according to an embodiment of the present disclosure.

An overall configuration of a process cartridge 1 will be described with reference to FIGS. 1 and 2. The process cartridge 1 includes, as shown in FIG. 1, a drum cartridge 2 and a toner cartridge 3. The toner cartridge 3 is attachable to the drum cartridge 2 along an attaching direction shown in FIG. 1.

1.1 Drum Cartridge

The drum cartridge 2 includes a photosensitive drum 4, a charging roller 12, a developing device 5, a cleaner 6, and a conveyer tube 7.

The photosensitive drum 4 is rotatable about an axis, which extends in an axial direction. The photosensitive drum 4 extends in the axial direction and has a cylindrical shape. In the following description, the axial direction may refer to a direction along the axis of the photosensitive drum 4. In this regard, however, the axial direction may incline with respect to the axis of the photosensitive drum 4. More specifically, while the photosensitive drum 4 has one end and the other end apart from the one end along the extending direction, the axial direction may incline with respect to the axis of the photosensitive drum 4 as long as the axial direction extends along a line that extends through a point, which is c in the one end of the photosensitive drum 4, and a point, which is included in the other end of the photosensitive drum 4.

The charging roller 12 may electrically charge a circumferential surface of the photosensitive drum 4. The charging roller 12 is arranged to contact the circumferential surface of the photosensitive drum 4.

The developing device 5 may supply toner to the circumferential surface of the photosensitive drum 4 and includes a developing chamber 9. The developing device 5 further includes a screw 16, a developing roller 8, and a supplying roller 20.

The developing chamber 9 may, while the toner cartridge 3 is attached to the drum cartridge 2, accept the toner from the toner cartridge 3. The developing chamber 9 is located at a downstream side in the developing device 5 with regard to the attaching direction.

The screw 16 may convey the toner in the developing chamber 9 in the axial direction. Specifically, the screw 16 may convey the toner in the developing chamber 9 from a developer inlet 33A (see FIG. 9) toward a developer outlet 33B (see FIG. 9) in the axial direction. The screw 16 extends along the axial direction and is arranged at a position between the developing roller 8 and a position of the developer inlet 33A and the developer outlet 33B.

The developing roller 8 may supply the toner in the developing chamber 9 to the circumferential surface of the photosensitive drum 4. The developer roller 8 is partly accommodated in the developing chamber 9. The developing roller 8 may be arranged to contact the circumferential surface of the photosensitive drum 4 or may be separated from the circumferential surface of the photosensitive drum 4.

The supplying roller 20 may supply the toner in the developing chamber 9 to the developing roller 8. The supplying roller 20 is accommodated in the developing chamber 9 and arranged to contact a circumferential surface of the developing roller 8.

The cleaner 6 may remove the toner from the circumferential surface of the photosensitive drum 4. The cleaner 6 includes a cleaning blade 13.

The cleaning blade 13 is arranged to contact the circumferential surface of the photosensitive drum 4. The cleaning blade 13 may scrape the toner off from the circumferential surface of the photosensitive drum 4 as the photosensitive drum 4 rotates. The toner removed by the cleaning blade 13 from the photosensitive drum 4 may stay inside the cleaner 6.

Figure 2:
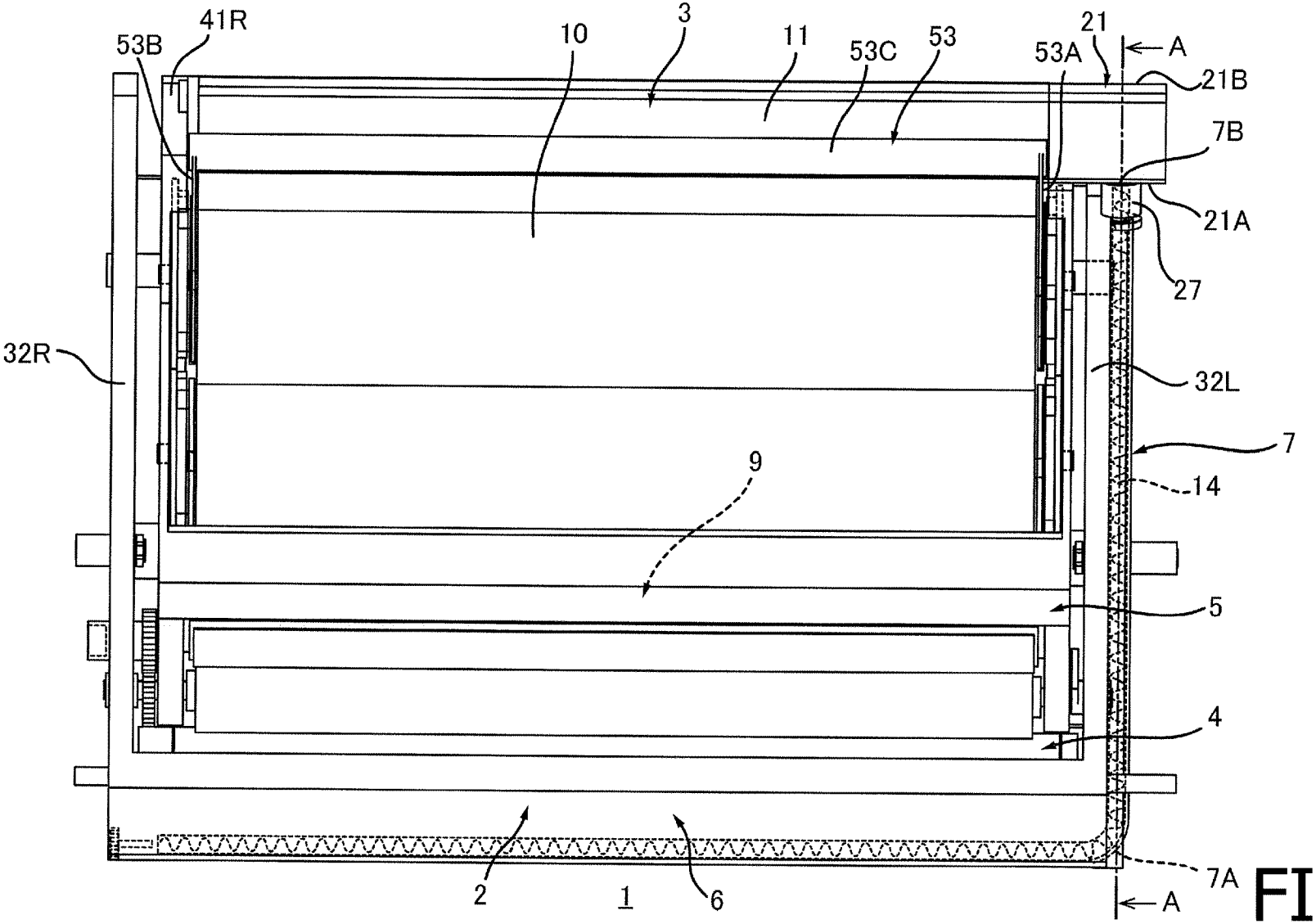
FIG. 2 illustrates a plane view of the process cartridge according to the embodiment of the present disclosure.

The conveyer tube 7 is, as shown in FIG. 2, for conveying the toner removed from the photosensitive drum 4 by the cleaner 6. The conveyer tube 7 extends in the attaching direction, in which the toner cartridge 3 is attachable to the drum cartridge 2. The conveyer tube 7 includes a first end 7A along the attaching direction and a second end 7B apart from the first end 7A along the attaching direction. The first end 7A of the conveyer tube 7 is connected with the cleaner 6. The second end 7B of the conveyer tube 7 is connected to a waste toner container 11, which will be described later, while the toner cartridge 3 is attached to the drum cartridge 2. The conveyer tube 7 includes a screw 14.

The screw 14 may convey the toner from the cleaner 6 at the waste toner container 11. The screw 14 is arranged inside the cleaner 6 and inside the conveyer tube 7.

1.2 Toner Cartridge

The toner cartridge 3 may store the toner to be supplied to the photosensitive drum 4. The toner cartridge 3 may supply the toner to the developing chamber 9 while the toner cartridge 3 is attached to the drum cartridge 2. While the toner cartridge 3 is attached to the drum cartridge 2, the toner cartridge 3 and the photosensitive drum 4 are arranged on different sides of the developing roller 8 along the attaching direction. In other words, the toner cartridge 3 is located at a position on a side of the developing roller 8 opposite to the photosensitive drum 4 in the attaching direction. The toner cartridge 3 includes a toner container 10 and a waste toner container 11.

The toner container 10 may store the toner to be supplied to the photosensitive drum 4. The toner container 10 extends in the axial direction. The toner container 10 and the developing chamber 9 communicate while the toner cartridge 3 is attached to the drum cartridge 2. The toner container 10 is, while the toner cartridge 3 is attached to the drum cartridge 2, at least partly located between the waste toner container 11 and the developing chamber 9 along the attaching direction. Preferably, the entire toner container 10 may be located between the waste toner container 11 and the developing chamber 9 with regard to the attaching direction while the toner cartridge 3 is attached to the drum cartridge 2.

The toner container 10 includes, as shown in FIG. 1, a plurality of agitators 17, 18. In other words, the toner cartridge 3 may include a plurality of agitators 17, 18.

The plurality of agitators 17, 18 may stir the toner in the toner container 10 and convey the toner in the toner container 10 at a toner outlet 51A. The plurality of agitators 17, 18 align along the attaching direction. The agitator 17 is located between the toner outlet 51A and the agitator 18 along the attaching direction. The agitator 17 may convey the toner in the toner container 10 in the axial direction from a toner inlet 51B (see FIG. 11) at the toner outlet 51A (see FIG. 11).

The waste toner container 11 may, as shown in FIG. 2, contain the toner conveyed through the conveyer tube 7 while the toner cartridge 3 is attached to the drum cartridge 2. The waste toner container 11 is immovable with respect to the toner container 10. Specifically, the waste toner container 11 may be integral with the toner container 10. The waste toner container 11 is, as shown in FIG. 1, divided from the toner container 10 by a partition 15, which is between the waste toner container 11 and the toner container 10. The waste toner container 11 and the toner container 10 may not communicate directly.

2. Detailed Configuration of the Waste Toner Container

Detailed configuration of the waste toner container 11 will be described below with reference to the drawings. As shown in FIG. 1, the waste toner container 11 extends in the attaching direction. A dimension of the waste toner container 11 in the attaching direction is smaller than a dimension of the toner container 10 in the attaching direction. Meanwhile, as shown in FIG. 2, the waste toner container 11 extends in an intersecting direction, which intersects with the attaching direction and with the axial direction. Specifically, the intersecting direction may intersect orthogonally with the attaching direction and with the axial direction. The intersecting direction may be, for example, a direction of gravity. A dimension of the waste toner container 11 in the intersecting direction is smaller than a dimension of the toner container 10 in the intersecting direction. The waste toner container 11 is located on an inner side of the toner container 10 with regard to the intersecting direction. In other words, the waste toner container 11 stays within a range of the toner container 10 with regard to the intersecting direction. Therefore, a top of the waste toner container 11 is located at a lower position than a top of the toner container 10 with regard to the direction of gravity, and a bottom of the waste toner container 11 is located at a higher position than a bottom of the toner container 10. The waste toner container 11 includes a first end 11A along the intersecting direction and a second end 11B apart from the first end 11A along the intersecting direction. Moreover, as shown in FIG. 2, the waste toner container 11 extends in the axial direction. A dimension of the waste toner container 11 in the axial direction is greater than a dimension of the toner container 10 in the axial direction. The waste toner container 11 includes a protrusive portion 21 and a screw 19 (see FIG. 11).

Figure 3:
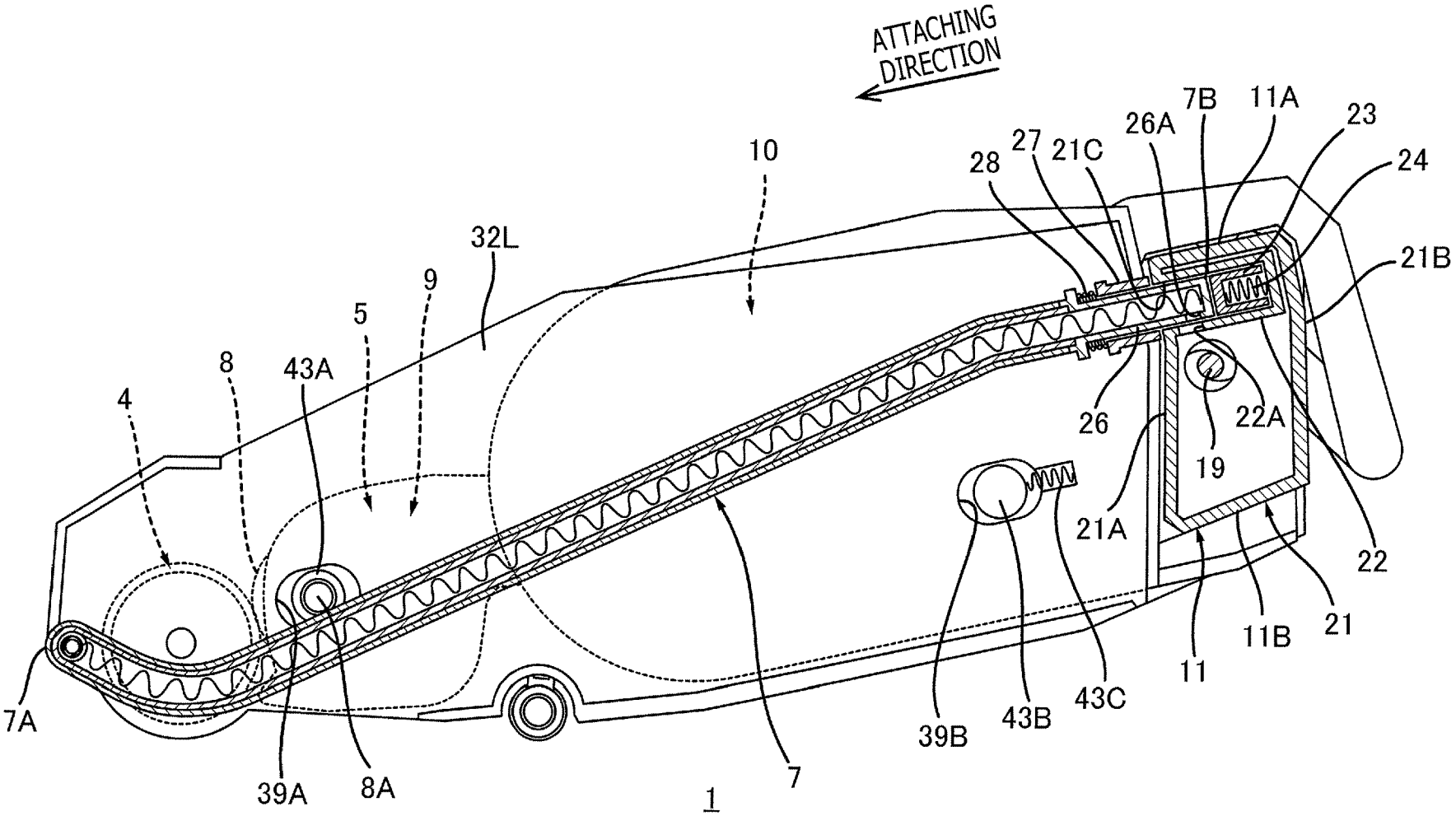
FIG. 3 illustrates a cross-sectional view of the process cartridge according to the embodiment of the present disclosure viewed at a line A-A shown in FIG. 2.

The protrusive portion 21 extends in the axial direction and protrudes outward with respect to the toner container 10 in the axial direction. Moreover, the protrusive portion 21 protrudes, while the toner cartridge 3 is attached to the drum cartridge 2, outward with respect to the photosensitive drum 4 and the developing chamber 9 in the axial direction. Further, the protrusive portion 21 protrudes, while the toner cartridge 3 is attached to the drum cartridge 2, outward with respect to a drum lateral wall 32L, which will be described later in detail, in the axial direction. The protrusive portion 21 faces the conveyer tube 7 along the attaching direction while the toner cartridge 3 is attached to the drum cartridge 2. The protrusive portion 21 includes a first outer surface 21A, which is on one side along the attaching direction, and a second outer surface 21B, which is on the other side along the attaching direction. The second outer surface 21B is on a side opposite to the conveyer tube 7 across the first outer surface 21A along the attaching direction. As shown in FIG. 3, the protrusive portion 21 includes an insertion opening 21C. Further, the protrusive portion 21 includes an insertion portion 22 and a shutter 23.

In the insertion opening 21C, inserted is the conveyer tube 7 while the toner cartridge 3 is attached to the drum cartridge 2. The insertion opening 21C is formed through the first outer surface 21A of the protrusive portion 21.

The conveyer tube 7 is inserted through the insertion opening 21C into the insertion portion 22 while the toner cartridge 3 is attached to the drum cartridge 2. The insertion portion 22 is located between the first end 11A and the second end 11B of the waste toner container 11 along the intersecting direction. The insertion portion 22 is located inside the protrusive portion 21. The insertion portion 22 extends in the attaching direction and has a cylindrical shape. An inner room in the insertion portion 22 and the insertion opening 21C communicate. The insertion portion 22 includes an opening 22A, through which the conveyer tube 7 may be inserted.

The opening 22A may, while the conveyer tube 7 is inserted therein, allow the toner conveyed by the conveyer tube 7 to enter the protrusive portion 21. The opening 22A overlaps an opening 26A of the conveyer tube 7 while the conveyer tube 7 is inserted therein. The opening 22A is formed through a circumferential wall of the insertion portion 22. The opening 22A and the inner room in the protrusive portion 21 communicate. The opening 22A is, while the process cartridge 1 is attached to an image forming apparatus 100, which will be described later in detail, located at a lower position with respect to the opening 26A of the conveyer tube 7.

The shutter 23 is located inside the insertion portion 22. The shutter 23 is movable along the attaching direction between an open position (see FIG. 3), in which the opening 22A is open, and a closure position (see FIG. 12A), in which the opening 22A is closed. While the shutter 23 is at the open position, the shutter 23 may be pushed toward the closure position by a spring 24.

The screw 19 may, as shown in FIG. 11, convey the toner in the protrusive portion 21 in the axial direction. The screw 19 extends between one end and the other end of the waste toner container 11 along the axial direction.

3. Detailed Configuration of the Conveyer Tube

Detailed configuration of the conveyer tube 7 will be described below.

3.1 Layout of the Conveyer Tube

As shown in FIG. 2, the conveyer tube 7 is located on a side of the drum lateral wall 32L opposite to the developing device 5 in the axial direction. In other words, the conveyer tube 7 and the developing device 5 are arranged on opposite sides of the drum lateral wall 32L from each other along the axial direction. The conveyer tube 7 is attached to the drum lateral wall 32L.

The conveyer tube 7 is, as shown in FIG. 3, arranged to overlap the photosensitive drum 4, the toner container 10, and the waste toner container 11 in a view along the axial direction. The term "overlap" may not necessarily require contact between the conveyer tube 7 and the photosensitive drum 4, the toner container 10, or the waste toner container 11. Therefore, while the conveyer tube 7 may be spaced apart from the photosensitive drum 4, the toner container 10, or the waste toner container 11, the conveyer tube 7 may still overlap the photosensitive drum 4, the toner container 10, and the waste toner container 11 as long as the conveyer tube 7 conceals the photosensitive drum 4, the toner container 10, and the waste toner container 11 at least partly in the view along the axial direction. Moreover, the conveyer tube 7 may overlap the photosensitive drum 4, the toner container 10, and the waste toner container 11 even if some other item or member is interposed between the conveyer tube 7 and the photosensitive drum 4, the toner container 10, or the waste toner container 11 as long as the conveyer tube 7 conceals the photosensitive drum 4, the toner container 10, and the waste toner container 11 at least partly in the view along the axial direction even with or without the interposing item or member. The overlapping layout of the conveyer tube 7 with the photosensitive drum 4, the toner container 10, and the waste toner container 11 may include various patterns.

For example, as shown in FIGS. 4A-4B, 5A-5B, and FIG. 6A, the conveyer tube 7 overlaps the photosensitive drum 4, the toner container 10, and the waste toner container 11 in the view along the axial direction. With regard to the toner container 10, the conveyer tube 7 may overlap the toner container 10 as long as at least a part of the toner container 10, which may or may not contain toner therein, overlaps the conveyer tube 7.

More specifically, as shown in FIG. 4A, the toner container 10 may include a plurality of inner rooms 10A, 10B, which communicate each other, and at least one of the inner rooms 10A, 10B may contain toner therein. In this example, in the view along the axial direction, the conveyer tube 7 overlaps the toner container 10 while one of the inner rooms 10A, 10B overlaps the conveyer tube 7.

For another example, as shown in FIG. 4B, the conveyer tube 7 may overlap the inner room 10A, which is in an upper position and contains no toner, in the view along the axial direction. In this example, while the inner room 10A that overlaps the conveyer tube 7 and the inner room 10B that contains toner communicate, the conveyer tube 7 overlaps the toner container 10.

For another example, as shown in FIG. 5A, the conveyer tube 7 may overlap the inner room 10B, which is in a lower position and contains no toner, in the view along the axial direction. In this example, while the inner room 10B that overlaps the conveyer tube 7 and the inner room 10A that contains toner communicate, the conveyer tube 7 overlaps the toner container 10.

For another example, as shown in FIG. 5B, the toner container 10 may include a protrusion 10C that protrudes inward in the inner room. In this example, the conveyer tube 7 overlaps the toner container 10 while a position of the protrusion 10C is included in the inner room and overlaps the conveyer tube 7 in the view along the axial direction.

For another example, as shown in FIG. 6A, the conveyer tube 7 overlaps the toner container 10 as long as at least a part of a wall 10D that outlines the inner room of the toner container 10 overlaps the conveyer tube 7. In particular, the conveyer tube 7 overlaps the toner container 10 while a protrusion 10E that protrudes from the wall 10D of the toner container 10 in the view along the axial direction.

For example, further, as shown in FIGS. 6B and 7A, the conveyer tube 7 overlaps the photosensitive drum 4, the toner container 10, and the waste toner container 11 in the view along the axial direction. With regard to the waste toner container 11, the conveyer tube 7 may overlap the waste toner container 11 as long as at least a part of an inner room in the waste toner container 11, which may or may not contain toner therein, overlaps the conveyer tube 7.

More specifically, in FIGS. 6B and 7A, in FIG. 6B, the conveyer tube 7 overlaps an upper one of inner rooms in the waste toner container 11; and in FIG. 7A, the conveyer tube 7 overlaps one of inner rooms of the waste toner container 11 which is located between the toner container 10 and another one of the inner rooms that contains toner.

Meanwhile, as shown in FIGS. 7B and 8A-8B, the conveyer tube 7 may overlap the developing chamber 9 in the developing device 5 in the view along the axial direction additionally to the photosensitive drum 4, the toner container 10, and the waste toner container 11. With regard to the developing chamber 9, the conveyer tube 7 may overlap a part of an inner room in the developing chamber 9 that may or may not accommodate the developing roller 8. In FIGS. 7B and 8A-8B, the conveyer tube 7 overlaps the developing chamber 9 while at least a part of the developing chamber 9 overlaps the conveyer tube 7. For example, in FIG. 7B, the conveyer tube 7 overlaps a part of the developing chamber 9 that does not accommodate the developing roller 8. For another example, in FIG. 8A, the conveyer 9 overlaps a part of an inner room in the developing chamber 9 that accommodates the developing roller 8 and another part of the inner room in the developing chamber arranged between the part that accommodates the developing roller 8 and the toner container 10. In FIG. 8B, the conveyer tube 7 does not overlap the part of the inner room in the developing chamber 9 that accommodates the developing roller 8 but overlaps the another part of the inner room in the developing chamber arranged between the part that accommodates the developing roller 8 and the toner container 10.

3.2 Configuration of the Conveyer Tube

The conveyer tube 7 is, as shown in FIG. 3, coupled to the protrusive portion 21 while the toner cartridge 3 is attached to the drum cartridge 2. The conveyer tube 7 is movable along the attaching direction to be coupled to and decoupled from the protrusive portion 21. The conveyer tube 7 includes an insertion cylinder 26 and a shutter 27.

The insertion cylinder 26 is, while the toner cartridge 3 is attached to the drum cartridge 2, inserted in the insertion portion 22 through the insertion opening 21*c*. The insertion cylinder 26 extends in the attaching direction. The insertion cylinder 26 includes the second end 7B of the conveyer 7. The insertion cylinder includes an opening 26A.

The opening 26A is an outlet, through which the toner conveyed in the conveyer tube 7 may be discharged outside the conveyer tube 7. The opening 26A may overlap the opening 22A formed in the insertion portion 22 while the insertion cylinder 26 is inserted in the insertion portion 22. The opening 26A is formed through a circumferential wall of the insertion cylinder 26. The opening 26A is, while the process cartridge 1 is attached to the image forming apparatus 100, located at an upper position with respect to the opening 22A in the insertion portion 22.

The shutter 27 is located on an outer circumferential surface of the insertion cylinder 26. The shutter 27 is movable between an open position (see FIGS. 2-3), in which the opening 26A is open, and a closure position (see FIG. 9), in which the opening 26A is closed. The shutter 27 is movable along the attaching direction to move between the open position and the closure position. The shutter 27 in the open position may be urged by the spring 28 toward the closure position.

4. Detailed Configurations of the Drum Cartridge and the Toner Cartridge

In the following paragraphs, described will be the drum cartridge 2 and the toner cartridge 3 in detail with reference to FIGS. 9-13B.

As shown in FIG. 9, the developing device 5 in the drum cartridge 2 includes a developer inlet 33A and a developer outlet 33B. The drum cartridge 2 includes a developer shutter 34. The developer shutter 34 is movable between an open position (see FIG. 13B), in which the shutter 34 opens the developer inlet 33A and the developer outlet 33B, and a closure position (see FIGS. 10A-10B), in which the shutter 34 closes the developer inlet 33A and the developer outlet 33B.

Meanwhile, as shown in FIG. 11, the toner container 10 in the toner cartridge 3 includes the toner outlet 51A and the toner inlet 51B. The toner cartridge 3 includes a toner shutter 52. The toner shutter 52 is movable between an open position (see FIG. 13A), in which the shutter 52 opens the toner outlet 51A and the toner inlet 51B, and a closure position (see FIGS. 12A-12B), in which the shutter 52 closes the toner outlet 51A and the toner inlet 51B.

The developer shutter 34 and the toner shutter 52 are movable in conjunction with each other while the toner cartridge 3 is attached to the drum cartridge 2. Therefore, the developer shutter 34 and the toner shutter 52 are enabled to move jointly between the closure positions and the open positions by a user's operation while the toner cartridge 3 is attached to the drum cartridge 2.

In the following paragraphs, described in detail will be configurations of the drum cartridge 2 and the toner cartridge 3.

4.1 Drum Cartridge

The drum cartridge 2 includes, as shown in FIG. 9, a drum frame 31 and the developing device 5 mentioned earlier.

4.1.1 Drum Frame

The drum frame 31 includes the cleaner 6 and two (2) drum lateral walls 32L, 32R, which were mentioned earlier.

The drum lateral wall 32L is located between the photosensitive drum 4 and the conveyer tube 7, and between the developing device 5 and the conveyer tube 7, with regard to the axial direction. The drum lateral wall 32L extends in the attaching direction. To the drum lateral wall 32L, attached is the conveyer tube 7. The drum lateral wall 32L includes, as shown in FIG. 3, a first elongated hole 39A and a second elongated hole 39B.

In the first elongated hole 39A, inserted is one end of a shaft 8A of the developing roller 8. In the first elongated hole 39A, the one end of the shaft 8A is covered by a first cover 43A of the developing device 5, which will be described later in detail. The elongated hole 39A is elongated in the attaching direction. The second elongated hole 39B is located apart from the first elongated hole 39A in the attaching direction. The second elongated hole 39B is located at a position on a side opposite to the photosensitive drum 4 across the first elongated hole 39A with regard to the attaching direction. In the second elongated hole 39B, inserted is a first boss 43B of the developing device 5, which will be described later in detail. The second elongated hole 39B is elongated in the attaching direction.

The drum lateral wall 32R is, as shown in FIG. 9, located on a side of the photosensitive drum 4, and a side of the developing device 5, opposite to the drum lateral wall 32L in the axial direction. The drum lateral wall 32R extends in the attaching direction. The drum lateral wall 32R, together with the drum lateral wall 32L, supports the photosensitive drum 4 and the developing device 5. The drum lateral wall 32R includes a third elongated hole, which is not shown but is formed to have the same shape as the first elongated hole 39A in the drum lateral wall 32L, and a fourth elongated hole, which is not shown but is formed to have the same shape as the second elongated hole 39B in the drum lateral wall 32L. In the third elongated hole, inserted is the other end of the shaft 8A of the developing roller 8. In the third elongated hole, the other end of the shaft 8A is covered by a second cover 44A of the developing device 5, which will be described later in detail; and in the fourth elongated hole, inserted is a second boss 44B of the developing device 5, which will be described later in detail.

4.1.2 Developing Device

The developing device 5 includes a developer frame 33, a developer shutter 34, a first drum disk 35, the second drum disk 36, a third drum disk 37, and a fourth drum disk 38.

4.1.2.1 Developer Frame

The developer frame 33 includes the developing chamber 9 mentioned earlier. The developer frame 33 includes two (2) developer lateral walls 41L, 41R, and a partition wall 42.

The developer lateral wall 41L is located on a side of the drum lateral wall 32L opposite to the conveyer tube 7 in the axial direction. In other words, the developer lateral wall 41L and the conveyer tube 7 are on opposite sides of the drum lateral wall 32L to each other along the axial direction. The developer lateral wall 41L extends in the attaching direction. The developer lateral wall 41L includes, as shown in FIGS. 3 and 9, the first cover 43A and the first boss 43B.

The first cover 43A has a cylindrical shape and extends in the axial direction. In the first cover 43A, inserted is the one end of the shaft 8A of the developing roller 8. The first cover 43A covers the inserted one end of the shaft 8A of the developing roller 8. The shaft 8A is rotatable with respect to the first cover 43A. The first cover 43A is inserted in the first elongated hole 39A in the drum lateral wall 32L.

The first boss 43B has a cylindrical shape and extends in the axial direction from the developer lateral wall 41L toward the drum lateral wall 32L. The first boss 43B is arranged to fit in the second elongated hole 39B in the drum lateral wall 32L. The first boss 43B is urged by a spring 43C toward downstream along the attaching direction.

The developer lateral wall 41R is, as shown in FIG. 9, located between the developer lateral wall 41L and the drum lateral wall 32L in the axial direction. The developer lateral wall 41R extends in the attaching direction and includes the second cover 44A and the second boss 44B. The developer lateral wall 41R and the developer lateral wall 41L align spaced apart from each other along the axial direction.

The second cover 44A has a cylindrical shape and extends in the axial direction. In the second cover 44A, inserted is the other end of the shaft 8A (see FIG. 3) of the developing roller 8. The second cover 44A covers the inserted other end of the shaft 8A of the developing roller 8. The shaft 8A is rotatable with respect to the second cover 44A. The second cover 44A is inserted in the third elongated hole, which is not shown, in the drum lateral wall 32L.

The second boss 44B has a cylindrical shape and extends in the axial direction from the developer lateral wall 41R toward the drum lateral wall 32R. The second boss 44B is arranged to fit in the fourth elongated hole, which is not shown, in the drum lateral wall 32R. The second boss 44B is urged by a spring, which is not shown, toward downstream along the attaching direction.

With the first cover 43A inserted in the first elongated hole 39A, the first boss 43B inserted in the second elongated hole 39B, the second cover 44A inserted in the third elongated hold, and the second boss 44B inserted in the fourth elongated hole, the developing device 5 is supported by the drum frame 31 movably in the attaching direction. Therefore, the developing chamber 9 is movable with respect to the photosensitive drum 4 along the attaching direction.

The partition wall 42, as shown in FIG. 10A, separates the toner cartridge 3 and the developing chamber 9 from each other while the toner cartridge 3 is attached to the drum cartridge 2. The partition wall 42 is, while the toner cartridge 3 is attached to the drum cartridge 2, arranged between the toner cartridge 3 and the developing chamber 9 along the attaching direction. The partition wall 42 extends in the intersecting direction and curves along an outer peripheral surface of the toner container 10, while the toner cartridge 3 is attached to the drum cartridge 2. The partition wall 42 includes, as shown in FIGS. 9 and 10A, the developer inlet 33A and the developer outlet 33B.

The developer inlet 33A may accept the toner from the toner cartridge 3. In particular, while the toner cartridge 3 is attached to the drum cartridge 2, further while the developer shutter 34 is in the open position, and while the toner shutter 52 is in the open position, the developer inlet 33A may accept the toner from the toner cartridge 3. The developer inlet 33A is, while the toner cartridge 3 is attached to the drum cartridge 2, located between the conveyer tube 7 and the developer outlet 33B in the axial direction. The developer inlet 33A is formed through the partition wall 42; therefore, the developer inlet 33A is continuous with the developing chamber 9.

The developer outlet 33B may discharge the toner, which may be excessive in the developing chamber 9. In particular, while the toner cartridge 3 is attached to the drum cartridge 2, further while the developer shutter 34 is in the open position, and while the toner shutter 52 is in the open position, the developer outlet 33B may discharge the toner from the developing chamber 9. The developer outlet 33B is located apart from the developer inlet 33A along the axial direction. The developer outlet 33B is formed through the partition wall 42; therefore, the developer outlet 33B is continuous with the developing chamber 9. The partition wall 42 is located between the developing chamber 9 and a position of the developer lateral walls 41R, 41L.

4.1.2.2 Developer Shutter

The developer shutter 34 is located on a side of the partition wall 42 opposite to the developing chamber 9. In other words, the developer shutter 34 and the developing chamber 9 are arranged on opposite sides of the partition wall 42 to each other. The developer shutter 34 is, while the toner cartridge 3 is detached from the drum cartridge 2, located in the closure position. The developer shutter 34 extends in the axial direction and in the intersecting direction and curves along the partition wall 42. The developer shutter 34 includes one end with regard to the axial direction and the other end apart from the one end with regard to the axial direction.

4.1.2.3 First Through Fourth Drum Disks

The first drum disk 35 may, in conjunction with the fourth drum disk 38 (see FIG. 10B), rotate to move the developer shutter 34 between the open position and the closure position. The first drum disk 35 is coupled to one end of the developer shutter 34. The first drum disk 35 is located on a side of the developer lateral wall 41L opposite to the drum lateral wall 32L in the axial direction. In other words, the first drum disk 35 and the drum lateral wall 32L are arranged on opposite sides of the developer lateral wall 41L to each other along the axial direction. The first drum disk 35 is rotatable with respect to the developer lateral wall 41L; therefore, the first drum disk 35 is rotatable with respect to the drum cartridge 2. The first drum disk 35 includes gear teeth 35A and a guide 35B. In this regard, the drum cartridge 2 includes the guide 35B.

The gear teeth 35A are formed on at least a part of a circumferential face of the first drum disk 35. The gear teeth 35A align along a rotating direction of the first drum disk 35.

The guide 35B extends in a radial direction of the first drum disk 35. The guide 35B is, while the toner cartridge 3 is attached to the drum cartridge 2, fitted with a plurality of bosses 54A (see FIG. 12A) in a first toner disk 54, which will be described later in detail. Therefore, while the toner cartridge 3 is attached to the drum cartridge 2, the first drum disk 35 is engaged with the first toner disk 54 and may rotate in conjunction with the first toner disk 54. The guide 35B extends, while the toner cartridge 3 is detached from the drum cartridge 2, in the attaching direction.

The second drum disk 36 may transmit a driving force to the first drum disk 35. The second drum disk 36 is located at a position upstream from the first drum disk 35 along the attaching direction. The second drum disk 36 is, while the toner cartridge 3 is attached to the drum cartridge 2, located between the first drum disk 35 and the waste toner container 11 in the attaching direction. The second drum disk 36 is located on a side of the developer lateral wall 41L opposite to the drum lateral wall 32L in the axial direction. In other words, the second drum disk 36 and the drum lateral wall 32L are on opposite sides of the developer lateral wall 41L to each other in the axial direction. The second drum disk 36 is rotatable with respect to the developer lateral wall 41L; therefore, the second drum disk 36 is rotatable with respect to the drum cartridge 2. The second drum disk 36 includes gear teeth 36A and a guide 36B.

The gear teeth 36A are formed on at least a part of a circumferential face of the second drum disk 36. The gear teeth 36A align along a rotating direction of the second drum disk 36. The gear teeth 36A mesh with the gear teeth 35A in the first drum disk 35; therefore, the second drum disk 36 may transmit the driving force to the first drum disk 35.

The guide 36B extends in a radial direction of the second drum disk 36. The guide 36B is, while the toner cartridge 3 is attached to the drum cartridge 2, fitted with a rib 55A (see FIG. 12A) in a second toner disk 55, which will be described later in detail. Therefore, while the toner cartridge 3 is attached to the drum cartridge 2, the second drum disk 36 is engaged with the second toner disk 55 and may rotate in conjunction with the second toner disk 55. The guide 36B extends, while the toner cartridge 3 is detached from the drum cartridge 2, in the attaching direction. When the guide 35B and the guide 36B align along the attaching direction, the guide 35B and the guide 36B may guide the toner cartridge 3 to be attached to or detached from the drum cartridge 2.

The third drum disk 37 may, as shown in FIGS. 9 and 10B, transmit a driving force to the fourth drum disk 38. The third drum disk 37 is located at a position upstream from the fourth drum disk 38 along the attaching direction. The third drum disk 37 is located on a side of the developer lateral wall 41R opposite to the drum lateral wall 32R along the axial direction. In other words, the third drum disk 37 and the drum lateral wall 32R are arranged on opposite sides of the developer lateral wall 41R to each other along the axial direction. Moreover, the third drum disk 37 is, while the toner cartridge 3 is attached to the drum cartridge 2, located on a side of the toner container 10 opposite to the second drum disk 36 in the axial direction. In other words, the third drum disk 37 and the second drum disk 36 are arranged on opposite sides of the toner container 10 to each other along the axial direction. The third drum disk 37 is rotatable with respect to the developer lateral wall 41R; therefore, the third drum disk 37 is rotatable with respect to the drum cartridge 2. The third drum disk 37 includes gear teeth 37A and a guide 37B.

The gear teeth 37A are formed on at least a part of a circumferential surface of the third drum disk 37. The gear teeth 37A align along a rotating direction of the third drum disk 37. The gear teeth 37A mesh with gear teeth 38A in the fourth drum disk 38, which will be described later in detail; therefore, the third drum disk 37 may transmit the driving force to the fourth drum disk 38.

The guide 37B extends in a radial direction of the third drum disk 37. The guide 37B is, while the toner cartridge 3 is attached to the drum cartridge 2, fitted with a plurality of bosses 56A (see FIG. 12B) in a third toner disk 56, which will be described later in detail. Therefore, while the toner cartridge 3 is attached to the drum cartridge 2, the third drum disk 37 is engaged with the third toner disk 56 and may rotate in conjunction with the third toner disk 56. The guide 37B extends, while the toner cartridge 3 is detached from the drum cartridge 2, in the attaching direction.

The fourth drum disk 38 may, in conjunction with the first drum disk 35, rotate to move the developer shutter 34 between the open position and the closure position. The fourth drum disk 38 is coupled to the other end of the developer shutter 34. The fourth drum disk 38 is located on a side of the developer lateral wall 41R opposite to the drum lateral wall 32R in the axial direction. In other words, the fourth drum disk 38 and the drum lateral wall 32R are arranged on opposite sides of the developer lateral wall 41R to each other along the axial direction. The fourth drum disk 38 is rotatable with respect to the developer lateral wall 41R; therefore, the fourth drum disk 38 is rotatable with respect to the drum cartridge 2. The fourth drum disk 38 includes gear teeth 38A and a guide 38B.

The gear teeth 38A are formed on at least a part of a circumferential surface of the fourth drum disk 38. The gear teeth 38A align along a rotating direction of the fourth drum disk 38.

The guide 38B extends in a radial direction of the fourth drum disk 38. The guide 38B is, while the toner cartridge 3 is attached to the drum cartridge 2, fitted with a plurality of bosses 57A (see FIG. 12B) in a fourth toner disk 57, which will be described later in detail. Therefore, while the toner cartridge 3 is attached to the drum cartridge 2, the fourth drum disk 38 is engaged with the fourth toner disk 57 and may rotate in conjunction with the fourth toner disk 57. The guide 38B extends, while the toner cartridge 3 is detached from the drum cartridge 2, in the attaching direction. When the guide 37B and the guide 38B align along the attaching direction, the guide 37B and the guide 38B may guide the toner cartridge 3 to be attached to or detached from the drum cartridge 2.

4.2 Detailed Configuration of the Toner Cartridge

As shown in FIG. 11, the toner container 10 in the toner cartridge 3 includes the toner outlet 51A and the toner inlet 51B. The toner cartridge 3 further includes the toner shutter 52, the first toner disk 54, the second toner disk 55, the third toner disk 56, the fourth toner disk 57, and a handle 53.

4.2.1 Toner Outlet and Toner Inlet

The toner outlet 51A may discharge the toner from the toner container 10. In particular, while the toner cartridge 3 is attached to the drum cartridge 2, further while the developer shutter 34 is in the open position, and while the toner shutter 52 is in the open position, the toner outlet 51B may discharge the toner from the toner container 10. The toner discharged through the toner outlet 51A may enter the developing device 5 through the developer outlet 33A (see FIG. 9). The toner outlet 51A is, while the toner cartridge 3 is attached to the drum cartridge 2, located between the conveyer tube 7 and the toner inlet 51B in the axial direction. The toner outlet 51A is formed through a circumferential wall of the toner container 10; therefore, the toner outlet 51A is continuous with the inner room in the toner container 10.

The toner inlet 51B may accept the toner discharged out of the developing device 5 through the developer outlet 33B (see FIG. 9). In particular, while the toner cartridge 3 is attached to the drum cartridge 2, further while the developer shutter 34 is in the open position, and while the toner shutter 52 is in the open position, the toner inlet 51B may accept the toner discharged from the developing device 5 through the developer outlet 33B to return to the toner container 10. The toner inlet 51B is, while the toner cartridge 3 is attached to the drum cartridge 2, located apart from the toner outlet 51A along the axial direction. The toner inlet 51B is formed through the circumferential wall of the toner container 10; therefore, the toner inlet 51B is continuous with the inner room in the toner container 10.

4.2.2 Toner Shutter

The toner shutter 52 is, as shown in FIG. 11, while the toner cartridge 3 is attached to the drum cartridge 2, located on a side of the toner container 10 opposite to the waste toner container 11 in the attaching direction. In other words, the toner shutter 52 and the waste toner container 11 are arranged on opposite sides of the toner container 10 to each other. The toner shutter 52 is, while the toner cartridge 3 is detached from the drum cartridge 2, located in the closure position. The toner shutter 52 extends in the axial direction and in the intersecting direction and curves along the circumferential surface of the toner container 10. The toner shutter 52 includes one end with regard to the axial direction and the other end apart from the one end with regard to the axial direction.

4.2.3 First Through Fourth Toner Disks

The first toner disk 54 may, as shown in FIGS. 11 and 12A, in conjunction with the fourth toner disk 57, rotate to move the toner shutter 52 between the open position and the closure position. The first toner disk 54 is coupled to the one end of the toner shutter 52. The first toner disk 54 is located on a side of the toner container 10 opposite to the fourth toner disk 57 in the axial direction. In other words, the first toner disk 54 and the fourth toner disk 57 are arranged on opposite sides of the toner container 10 to each other along the axial direction. The first toner disk 54 is rotatable with respect to the toner container 10. The first toner disk 54 is arranged to face the first drum disk 35 (see FIG. 9) of the drum cartridge 2 along the axial direction while the toner cartridge 3 is attached to the drum cartridge 2. The first toner disk 54 is located between the toner outlet 51A and the insertion portion 22 along the axial direction. The first toner disk 54 includes the plurality of bosses 54A.

The bosses 54A align spaced apart from one another along a radial direction of the first toner disk 54. At a position between the bosses 54A, located is a rotational center of the first toner disk 54. The bosses 54A protrude outward from the first toner disk 54 in the axial direction to extend away from the toner container 10. Each of the bosses 54A has a cylindrical shape and fits in the guide 35B (see FIG. 10A) in the first drum disk 35 while the toner cartridge 3 is attached to the drum cartridge 2. Therefore, the first toner disk 54 may, while the toner cartridge 3 is attached to the drum cartridge 2, rotate in conjunction with the first drum disk 54.

The second toner disk 55 may, while the toner cartridge 3 is attached to the drum cartridge 2, transmit a driving force to the second drum disk 36 (see FIG. 9) without transmitting the driving force to the first toner disk 54. The second toner disk 55 is located apart from the first toner disk 54 along the attaching direction and is located between the first toner disk 54 and the waste toner container 11 in the attaching direction. The second toner disk 55 is rotatable with respect to the toner container 10. The second toner disk 55 faces the second drum disk 36 in the drum cartridge 2 along the axial direction while the toner cartridge 3 is attached to the drum cartridge 2. The second toner disk 55 is at a position closer than the third toner disk 56 to the protrusive portion 21 with regard to the axial direction. The second toner disk 55 is located between the toner outlet 51A and the protrusive portion 22 with regard to the axial direction. The second toner disk 55 includes the rib 55A.

The rib 55A extends in a radial direction of the second toner disk 55. The rib 55A includes one end and the other end apart from the one end along the radial direction of the second toner disk 55. At a position between the one end and the other end of the rib 55A, located is a rotational center of the second toner disk 55. The rib 55A protrudes outward from the second toner disk 55 along the axial direction to extend away from the toner container 10. The rib 55A fits in the guide 36B (see FIG. 10A) in the second drum disk 36 while the toner cartridge 3 is attached to the drum cartridge 2. Therefore, the second toner disk 55 may, while the toner cartridge 3 is attached to the drum cartridge 2, rotate in conjunction with the second drum disk 36.

The third toner disk 56 may, as shown in FIGS. 11 and 12B, while the toner cartridge 3 is attached to the drum cartridge 2, transmit a driving force to the third drum disk 37 (see FIG. 9) without transmitting the driving force to the fourth toner disk 57. The third toner disk 56 is located apart from the fourth toner disk 57 along the attaching direction and is located between the fourth toner disk 57 and the waste toner container 11 in the attaching direction. The third toner disk 56 is rotatable with respect to the toner container 10. The third toner disk 56 is located on a side of the toner container 10 opposite to the second toner disk 55 in the axial direction. In other words, the third toner disk 56 and the second toner disk 55 are on opposite sides of the toner container 10 to each other along the axial direction. The third toner disk 56 faces the third drum disk 37 (see FIG. 9) in the drum cartridge 2 along the axial direction while the toner cartridge 3 is attached to the drum cartridge 2. The third toner disk 56 includes the plurality of bosses 56A.

The bosses 56A align spaced apart from one another along a radial direction of the third toner disk 56. At a position between the bosses 56A, located is a rotational center of the third toner disk 56. The bosses 56A protrude outward from the third toner disk 56 in the axial direction to extend away from the toner container 10. Each of the bosses 56A has a cylindrical shape and fits in the guide 37B (see FIG. 10B) in the third drum disk 37 while the toner cartridge 3 is attached to the drum cartridge 2. Therefore, the third toner disk 56 may, while the toner cartridge 3 is attached to the drum cartridge 2, rotate in conjunction with the third drum disk 37.

The fourth toner disk 57 may, in conjunction with the first toner disk 54, rotate to move the toner shutter 52 between the open position and the closure position. The fourth toner disk 57 is coupled to the other end of the toner shutter 52. The fourth toner disk 57 is located on a side of the toner container 10 opposite to the first toner disk 54 along the axial direction. In other words, the first toner disk 54 and the fourth toner disk 57 are arranged on the opposite sides of the toner container 10 to each other along the axial direction. The fourth toner disk 57 is rotatable with respect to the toner container 10. The fourth toner disk 57 is arranged to face the fourth drum disk 38 (see FIG. 9) of the drum cartridge 2 along the axial direction while the toner cartridge 3 is attached to the drum cartridge 2. The fourth toner disk 57 includes a plurality of bosses 57A.

The bosses 57A align spaced apart from one another along a radial direction of the fourth toner disk 57. At a position between the bosses 57A, located is a rotational center of the fourth toner disk 57. The bosses 57A protrude outward from the fourth toner disk 57 in the axial direction to extend away from the toner container 10. Each of the bosses 57A has a cylindrical shape and fits in the guide 38B (see FIG. 10B) in the fourth drum disk 38 while the toner cartridge 3 is attached to the drum cartridge 2. Therefore, the fourth toner disk 57 may, while the toner cartridge 3 is attached to the drum cartridge 2, rotate in conjunction with the fourth drum disk 38.

4.2.4 Handle

As shown in FIGS. 11 and 12A-12B, the handle 53 may be, while the toner cartridge 3 is attached to the drum cartridge 2, operated by the user in order to move the developer shutter 34 and the toner shutter 52. The handle 53 is coupled to the second toner disk 55 and to the third toner disk 56. The handle 53 includes first end portions E1, at which the handle 53 is coupled to the second toner disk 55 and to the third toner disk 56, and second end portions E2, which are spaced apart from the first end portions E1. The handle 53 includes a gripper 53C, a first arm 53A, and a second arm 53B.

The gripper 53C may be gripped by the user, while the toner cartridge 3 is attached to the drum cartridge 2, in order to move the developer shutter 34 and the toner shutter 52. The gripper 53C is located on the second end portions E2 of the handle 53. The gripper 53C is, as shown in FIG. 13A, located on a side of the waste toner container 11 opposite to the toner container 10 while the toner cartridge 3 is attached to the drum cartridge 2, further while the toner shutter 52 is in the open position, and while the developer shutter 34 is in the open position. In other words, the second end portions E2 of the gripper 53C are located on the side of the waste toner container 11 opposite to the toner container 10 while the toner cartridge 3 is attached to the drum cartridge 2, further while the toner shutter 52 is in the open position, and while the developer shutter 34 is in the open position. On the other hand, the second end portions E2 of the handle are, while the toner cartridge 3 is attached to the drum cartridge 2, but while the toner shutter 52 is in the closure position, and further while the developer shutter 34 is in the closure position, as shown in FIG. 12A, located at a position on an upper side of the waste toner container 11. The gripper 53C extends in the axial direction, as shown in FIG. 11, and includes one end and the other end apart from the one end along the axial direction.

The first arm 53A is coupled to the one end of the gripper 53C and to the second toner disk 55 to couple the one end of the gripper 53C with the second toner disk 55. The first arm 53A is located between the insertion portion 22 and the toner container 10 in the axial direction. In this regard, as shown in FIG. 2, while the toner cartridge 3 is attached to the drum cartridge 2, the first arm 53A is located between the conveyer tube 7 and the toner container 10 in the axial direction. Meanwhile, the first arm 53A is, while the second end portions E2 of the handle 53 are on the side of the waste toner container 11 opposite to the toner container 10, in the view along the axial direction, as shown in FIG. 13A, bent to detour around the protrusive portion 21. Therefore, while the second end portions E2 of the handle 53 are located on the side of the waste toner container 11 opposite to the toner container 10, the first arm 53A may be prevented from interfering with the protrusive portion 21.

The second arm 53B is coupled to the other end of the gripper 53C and to the third toner disk 56 to couple the other end of the gripper 53C with the third toner disk 56. As shown in FIG. 2, while the toner cartridge 3 is attached to the drum cartridge 2, the second arm 53B is located between the developer lateral wall 41R and the waste toner container 11 in the axial direction. Therefore, while the second end portions E2 of the handle 53 are located on the side of the waste toner container 11 opposite to the toner container 10, the second arm 53B may be prevented from interfering with the waste toner container 11. The second arm 53B overlaps the waste toner container 11 in the view along the axial direction, as shown in FIG. 13A, while the second end portions E2 of the handle 53 are located on the side of the waste toner container 11 opposite to the toner container 10.

5. Opening/Closing Motions of the Developer Shutter and the Toner Shutter

In the following paragraphs, described will be opening and closing motions of the developer shutter 34 and the toner shutter 52 with reference to FIGS. 10A-10B, 12A-12B, and 13A-13B.

As mentioned earlier, while the toner cartridge 3 is attached to the drum cartridge 2, the first toner disk 54 (see FIG. 12A) is rotatable in conjunction with the first drum disk 35 (see FIG. 10A), the second toner disk 55 (see FIG. 12A) is rotatable in conjunction with the second drum disk 36 (see FIG. 10A), the third toner disk 56 (see FIG. 12B) is rotatable in conjunction with the third drum disk 37 (see FIG. 10B), and the fourth toner disk 57 (see FIG. 12B) is rotatable in conjunction with the fourth drum disk 38 (see FIG. 10B).

As the user rotates the handle 53, as shown in FIGS. 12A and 13A, the second toner disk 55 and the second toner disk 56 (see FIG. 12B) rotate along with the rotation of the handle 53. Meanwhile, the second drum disk 36 rotates along with the second toner disk 55, and the third toner disk 56 rotates along with the third drum disk 37 (see FIG. 10B).

Thereby, with the gear teeth 36A in the second drum disk 36 meshed with the gear teeth 35A in the first drum disk 35, the first drum disk 35 rotates along with the rotation of the second drum disk 36. Further, with the gear teeth 37A (see FIG. 10B) in the third drum disk 37 meshed with the gear teeth 38A (see FIG. 10B) in the fourth drum disk 38, the fourth drum disk 38 rotates along with the rotation of the third drum disk 37.

As the first drum disk 35 and the fourth drum disk 38 rotate, the developer shutter moves from the closure position to the open position. Meanwhile, as the first toner disk 54 rotates along with the first drum disk 35, and the fourth toner disk 57 rotates along with the fourth drum disk 38, as shown in FIG. 13A, the toner shutter 38 moves from the closure position to the open position in conjunction with the developer shutter 34.

6. Usage of the Process Cartridge

The process cartridge 1 described above may be attached to the image forming apparatus 100, as shown in FIG. 14. The toner cartridge 3 is attachable to and detachable from the drum cartridge 2 while the drum cartridge 2 is attached to the image forming apparatus 100. The process cartridge 1 is attachable to and detachable from the image forming apparatus 100 along the attaching direction of the toner cartridge 3 to the drum cartridge 2.

The image forming apparatus 100 may include a laser scanner unit 101, a transfer roller 102, a fuser 103, a sheet feeder 104, a feeder tray 105, and a sheet ejection tray 106.

The laser scanner unit 101 may expose the surface of the photosensitive drum 4 to light. The transfer roller 102 may transfer a toner image formed on the circumferential surface of the photosensitive drum 4 onto a sheet. The transfer roller 102 may contact the circumferential surface of the photosensitive drum 4. The fuser 103 may apply heat and pressure to the sheet with the toner image transferred thereon so that the toner image may be thermally fixed on the sheet. The sheet feeder 104 may feed sheets from the feeder tray 105 to a position between the photosensitive drum 4 and the transfer roller 102. The feeder tray 105 may store the sheets. The sheet ejection tray 106 may catch the sheet conveyed through the fuser 103.

7. Benefits

According to the process cartridge 1 described above, while the toner cartridge 3 is attached to the drum cartridge 2, as shown in FIG. 1, the toner cartridge 3 is located on the side of the developing roller 8 opposite to the photosensitive drum 4; and the toner container 100 in the toner cartridge 3 is entirely located between the waste toner container 11 and the developing chamber 9.

Meanwhile, in the view along the axial direction, as shown in FIG. 3, the conveyer tube 7 overlaps the photosensitive drum 4, the toner container 10, and the waste toner container 11.

Therefore, the conveyer tube 7 may be restrained from protruding outward from the photosensitive drum 4, the toner container 10, or the waste toner container 11 in the intersecting direction, e.g., a vertical direction, that intersect with the axial direction and with the attaching direction, in which the toner cartridge 3 is attachable to the drum cartridge 2.

Accordingly, the process cartridge 1 may be downsized in the intersecting direction. In other words, height of the process cartridge 1 may be reduced.

Further according to the process cartridge 1 described above, as shown in FIGS. 13A-13B, the developer shutter 34 and the toner shutter 52 may be moved in conjunction with each other by the user operating the handle 53 to place the second end portions E2 of the handle 53 at the position on the side of the waste toner container 11 opposite to the toner container 10 while the toner cartridge 3 is attached to the drum cartridge 2 from the closure positions (see FIGS. 10A and 12A) to the open positions (see FIGS. 13A-13B).

Moreover, the developer shutter 34 and the toner shutter 52 may be moved in conjunction with each other by the user operating the handle 53 to place the second end portions E2 of the handle 53 to the upper position with respect to the waste toner container 11 from the open positions to the closure positions.

Thus, operability of the process cartridge 1 to open and close the developer shutter 34 and the toner shutter 52 may be improved.

8. More Example

Although an example of carrying out the invention has been described, those skilled in the art will appreciate that there are numerous variations and permutations of the process cartridge that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, as shown in FIG. 15A, the second end portions E2 of the handle 53 may be located on the side of the waste toner container 11 opposite to the toner container 10 while the toner cartridge 3 is attached to the drum cartridge 2, further while the toner shutter 52 and the developer shutter 34 are in the closure positions. In this arrangement, as shown in FIG. 15B, the second end portions E2 of the handle 53 may be located at the upper positions with respect to the waste toner container 11 while the toner cartridge 3 is attached to the drum cartridge 2, and while the toner shutter 52 and the developer shutter 34 are in the open positions.

In this arrangement, the operability of the process cartridge 1 to open and close the developer shutter 34 and the toner shutter 52 may still be improved.

What is claimed is:

1. A process cartridge attachable to an image forming apparatus, the image forming apparatus comprising a body and a fuser, the process cartridge comprising:

a drum cartridge detachably attachable to the body, the drum cartridge comprising:

a photosensitive drum rotatable about an axis;

a drum frame supporting the photosensitive drum;

a cleaner configured to remove waste toner from the photosensitive drum;

a conveyer tube configured to convey the waste toner removed from the photosensitive drum; and a developing device supported by the drum frame, the developing device comprising:

a developing roller configured to supply toner to the photosensitive drum; and a developer frame comprising a developing chamber accommodating the developing roller; and a toner cartridge detachably attachable to the drum cartridge, the toner cartridge comprising:

a toner container configured to store the toner;

a waste toner container configured to store the waste toner; and a handle comprising a gripper, wherein, when the drum cartridge is attached to the body and the toner cartridge is attached to the drum cartridge, the toner cartridge is separated farther than the developing device from the fuser, wherein, when the drum cartridge is attached to the body and the toner cartridge is attached to the drum cartridge, the photosensitive drum, the developing roller and the toner container are arranged in an attaching direction in which the toner cartridge approaches the fuser when the toner cartridge is being attached to the drum cartridge attached to the body, and wherein, when the drum cartridge is attached to the body and the toner cartridge is attached to the drum cartridge, the waste toner container is arranged between the toner container and the gripper of the handle in the attaching direction.

2. The process cartridge according to claim 1, wherein the drum frame comprises a first lateral wall extending in the attaching direction and a second lateral wall extending in the attaching direction, and wherein the developing device is supported between the first lateral wall and the second lateral wall.

3. The process cartridge according to claim 2, wherein the drum cartridge comprises a conveyer tube extending along the second lateral wall.

4. The process cartridge according to claim 1, wherein the handle comprises a first end portion coupled to the toner cartridge and a second portion spaced apart from the first end portion, and wherein the gripper is located on the second end portion of the handle.

5. The process cartridge according to claim 1, wherein the axis of the photosensitive drum extends in an axial direction, and wherein the gripper of the handle extends in the axial direction.

6. A process cartridge attachable to an image forming apparatus, the image forming apparatus comprising a body and a fuser, the process cartridge comprising:

a drum cartridge detachably attachable to the body, the drum cartridge comprising:

a photosensitive drum;

a drum frame supporting the photosensitive drum;

a cleaner configured to remove waste toner from the photosensitive drum; and a developing device supported by the drum frame and comprising a developing roller configured to supply toner to the photosensitive drum; and a toner cartridge detachably attachable to the drum cartridge, the toner cartridge comprising:

a toner container configured to store the toner;

a handle comprising a gripper, wherein, when the drum cartridge is attached to the body and the toner cartridge is attached to the drum cartridge, the toner cartridge is separated farther than the developing device from the fuser, wherein, when the drum cartridge is attached to the body and the toner cartridge is attached to the drum cartridge, the photosensitive drum, the developing roller and the toner container are arranged in an attaching direction in which the toner cartridge approaches the fuser when the toner cartridge is being attached to the drum cartridge attached to the body, and wherein, when the drum cartridge is attached to the body and the toner cartridge is attached to the drum cartridge, the gripper of the handle is arranged on a side of the toner container of the toner cartridge opposite to the fuser and to the photosensitive drum in the attaching direction.

7. The process cartridge according to claim 6, wherein the drum frame comprises a first lateral wall extending in the attaching direction and a second lateral wall extending in the attaching direction, and wherein the developing device is supported between the first lateral wall and the second lateral wall.

8. The process cartridge according to claim 7, wherein the drum cartridge comprises a conveyer tube extending along the second lateral wall.

9. The process cartridge according to claim 6, wherein the handle comprises a first end portion coupled to the toner cartridge and a second portion spaced apart from the first end portion, and wherein the gripper is located on the second end portion of the handle.

10. A toner cartridge detachably attachable to a drum cartridge, the drum cartridge being detachably attachable to a body of an image forming apparatus, the image forming apparatus comprising a fuser, the drum cartridge comprising a photosensitive drum rotatable about an axis, a drum frame supporting the photosensitive drum, a cleaner configured to remove waste toner from the photosensitive drum, a conveyer tube configured to convey the waste toner removed from the photosensitive drum, and a developing device supported by the drum frame, the developing device comprising a developing roller configured to supply toner to the photosensitive drum and a developer frame comprising a developing chamber accommodating the developing roller, the toner cartridge comprising:

a toner container configured to store the toner;

a waste toner container configured to store the waste toner; and a handle comprising a gripper, wherein, when the toner cartridge is attached to the drum cartridge attached to the body, the toner cartridge is separated farther than the developing device from the fuser, wherein, when the toner cartridge is attached to the drum cartridge attached to the body, the photosensitive drum, the developing roller and the toner container are arranged in an attaching direction in which the toner cartridge approaches the fuser when the toner cartridge is being attached to the drum cartridge attached to the body, and wherein, when the toner cartridge is attached to the drum cartridge attached to the body, the waste toner container is arranged between the toner container and the gripper of the handle in the attaching direction.

11. The toner cartridge according to claim 10, wherein the handle comprises a first end portion coupled to the toner cartridge and a second portion spaced apart from the first end portion, and wherein the gripper is located on the second end portion of the handle.

12. The process cartridge according to claim 10, wherein the axis of the photosensitive drum extends in an axial direction, and wherein the gripper of the handle extends in the axial direction.

* * * * *